US007573442B2

(12) United States Patent
Aoki

(10) Patent No.: US 7,573,442 B2
(45) Date of Patent: Aug. 11, 2009

(54) DISPLAY, ACTIVE MATRIX SUBSTRATE, AND DRIVING METHOD

(75) Inventor: Yoshiro Aoki, Kitamoto (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 842 days.

(21) Appl. No.: 11/144,798

(22) Filed: Jun. 6, 2005

(65) Prior Publication Data

US 2005/0212732 A1 Sep. 29, 2005

Related U.S. Application Data

(63) Continuation of application No. PCT/JP03/15456, filed on Dec. 3, 2003.

(30) Foreign Application Priority Data

Dec. 6, 2002 (JP) ..... 2002-355338

(51) Int. Cl.
*G09G 3/30* (2006.01)

(52) U.S. Cl. ..... 345/76

(58) Field of Classification Search ..... 345/76–83, 345/204; 315/169.3
See application file for complete search history.

(56) References Cited

U.S. PATENT DOCUMENTS 6,229,506 B1 5/2001 Dawson et al.
6,373,454 B1 4/2002 Knapp et al.
6,661,180 B2 * 12/2003 Koyama ..... 315/169.3

FOREIGN PATENT DOCUMENTS

| | | |
|---|---|---|
| JP | 2002-351357 | 12/2002 |
| JP | 2003-43995 | 2/2003 |
| JP | 2003-177709 | 6/2003 |
| JP | 2003-195811 | 7/2003 |
| WO | WO 99/65011 | 12/1999 |
| WO | WO 01/75852 A1 | 10/2001 |

* cited by examiner

*Primary Examiner*—Sumati Lefkowitz
*Assistant Examiner*—Robert E Carter, III
(74) *Attorney, Agent, or Firm*—Oblon, Spivak, McClelland, Maier & Neustadt, P.C.

(57) ABSTRACT

There is provided a display including pixels arranged in a matrix, each pixel including a voltage signal input terminal to which a voltage signal is supplied, a drive control element including a first terminal connected to a first power supply terminal, a control terminal, and a second terminal that outputs a current corresponding to a voltage between the first and second terminals, a capacitor connected between the voltage signal input terminal and the control terminal, a current signal input terminal to which a current signal is supplied, a first switch connected between the current signal input terminal and the control terminal, a second switch connected between the current signal input terminal and the second terminal, an output control switch whose input terminal is connected to the second terminal, and a display element connected between a second power supply terminal and an output terminal of the output control switch.

18 Claims, 15 Drawing Sheets

DISPLAY, ACTIVE MATRIX SUBSTRATE, AND DRIVING METHOD

CROSS-REFERENCE TO RELATED APPLICATIONS

This is a Continuation Application of PCT Application No. PCT/JP03/15456, filed Dec. 3, 2003, which was published under PCT Article 21(2) in Japanese.

This application is based upon and claims the benefit of priority from prior Japanese Patent Application No. 2002-355338, filed Dec. 6, 2002, the entire contents of which are incorporated herein by reference.

BACKGROUND OF THE INVENTION

1. Field of the Invention

The present invention relates to a display, active matrix substrate, and driving method and, more particularly, to a display which controls the optical characteristic of a display element by a current to be supplied to it, an active matrix substrate usable for the display, and a driving method of the display.

2. Description of the Related Art

In a display such as an organic EL (ElectroLuminescence) display which controls the optical characteristics of a display element by a drive current to be supplied to it, if the drive current varies, the image quality becomes poor due to, e.g., uneven luminance. When such a display employs an active matrix driving system, the drive transistors which drive the display elements must have almost uniform characteristics between the pixels. In this display, however, since the transistors are normally formed on an insulating body such as a glass substrate, the transistor characteristics readily vary.

To solve this problem, U.S. Pat. Nos. 6,229,506 and 6,373,454B1 propose circuits shown in FIGS. 1 and 2, respectively. Characteristic correction of drive transistors by using these circuits will be described below.

In an organic EL display 1 using the circuit (threshold value cancel type) shown in FIG. 1, to set a given pixel 2 in a display state, an output control switch Sw2 is opened (OFF) by using a scan signal line 7 first. Simultaneously, a correction switch Sw3 is closed (ON) by using a scan signal line 15 to supply charges to capacitors C1 and C2 until no current flows between the source and drain of a drive transistor Tr. In this state, since the drain and gate of the drive transistor Tr are connected, the potential at a point A is equal to a threshold value Vth of the drive transistor Tr. During this time, a scan signal is supplied from a scan signal line driver (not shown) to a scan signal line 6 to close a selection switch Sw1. At the same time, a reset signal Vrst is supplied from a video signal line driver (not shown) to a video signal line 9.

After the above operation is completed, the correction switch Sw3 is opened, and the output control switch Sw2 is closed. In addition, a video signal Vsig is supplied from the video signal line driver to the video signal line 9. Accordingly, the gate potential of the drive transistor Tr varies from the threshold value Vth by an amount equal to the variate from Vrst to Vsig. As a result, a drive current corresponding to the variation amount is supplied from a power supply line 11 to an organic EL element 20 through the drive transistor Tr and output control switch Sw2.

As described above, according to the circuit shown in FIG. 1, the influence of the threshold value Vth on the drive current can be eliminated. Hence, even when the threshold value of the drive transistor Tr varies between the pixels 2, the influence of such variation on the drive current to be supplied to the organic EL element 20 can be minimized.

However, the drive current is affected not only by the threshold value of the drive transistor Tr but also by its mobility and dimensions. For this reason, it is difficult in the circuit shown in FIG. 1 to so improve the light emission uniformity that no display nonuniformity is visually recognized.

On the other hand, in the organic EL display 1 using the circuit (current copy type) shown in FIG. 2, to set the given pixel 2 in a display state, the output control switch Sw2 is opened first. Simultaneously, the selection switch Sw1 and a correction/write switch Sw4 are closed. In this state, a current Isig corresponding to the video signal is supplied between the source and drain of the drive transistor Tr by using a constant current circuit (not shown). With this operation, the voltage between the two electrodes of the capacitor C2 becomes the gate-to-source voltage necessary for supplying the current Isig to the channel of the drive transistor Tr.

After that, the selection switch Sw1 and correction/write switch Sw4 are opened, and the output control switch Sw2 is closed. The potential at a point B is set by the above operation to supply a drive current almost equal to the current Isig between the source and drain of the drive transistor Tr.

As described above, according to the circuit shown in FIG. 2, a current having a magnitude almost equal to that of the current Isig supplied as a video signal during the write period can be supplied between the source and drain of the drive transistor Tr even during the holding period next to the write period. For this reason, not only the influence of the threshold value Vth of the drive transistor Tr but also the influence of its mobility and dimensions on the drive current can be eliminated.

In the circuit shown in FIG. 2, however, when the pixel size becomes large, the wiring capacitance of video signal lines increases. In addition, when the write period is shortened along with micropatterning of the structure, the following problem rises. That is, when the current Isig is small, the write becomes insufficient. In other words, it becomes difficult to write a desired video signal.

BRIEF SUMMARY OF THE INVENTION

It is an object of the present invention to increase the controllability of a display operation by a scan signal to allow satisfactory display.

According to a first aspect of the present invention, there is provided a display comprising pixels arranged in a matrix, each of the pixels comprising a voltage signal input terminal to which a voltage signal is supplied, a drive control element including a first terminal connected to a first power supply terminal, a control terminal, and a second terminal that outputs a current corresponding to a voltage between the first and second terminals, a first capacitor connected between the voltage signal input terminal and the control terminal, a current signal input terminal to which a current signal is supplied, a first switch connected between the current signal input terminal and the control terminal, a second switch connected between the current signal input terminal and the second terminal, an output control switch whose input terminal is connected to the second terminal, and a display element connected between a second power supply terminal and an output terminal of the output control switch.

According to a second aspect of the present invention, there is provided a display comprising pixels arranged in a matrix, each of the pixels comprising a voltage signal input terminal to which a video signal and a reset signal are supplied as voltage signals, a drive control element including a first terminal connected to a first power supply terminal, a control terminal, and a second terminal that outputs a current corresponding to a voltage between the first terminal and the control terminal, a first capacitor connected between the voltage signal input terminal and the control terminal, an output control switch whose input terminal is connected to the second terminal, a display element connected between a second power supply terminal and an output terminal of the output control switch, and a correction signal supply control unit that forms first and second conductive paths during a period when the output control switch disconnects the display element from the second terminal, the first conductive path allowing a reset current to flow between the first and second terminals, and the second conductive path allowing charges to move between the control terminal and an outside of the pixel.

According to a third aspect of the present invention, there is provided a display comprising pixels arranged in a matrix, each of the pixels comprising a voltage signal input terminal to which a reset signal is supplied as a voltage signal during a correction period and a video signal is supplied as a voltage signal during a write period next to the correction period, a drive control element including a first terminal connected to a first power supply terminal, a control terminal, and a second terminal that outputs a drive current corresponding to the video signal, a first capacitor connected between the voltage signal input terminal and the control terminal, a display element to which the drive current is to be supplied, an output control switch that disconnects the display element from the second terminal during the correction period and the write period and connects the display element to the second terminal after the write period, and a correction signal supply control unit that forms first and second conductive paths during the correction period and disconnects the second conductive path during the write period, the first conductive path allowing a reset current to flow between the first and second terminals, and the second conductive path allowing charges to move between the control terminal and an outside of the pixel, wherein during the correction period, a first electrode of the first capacitor that is connected to the voltage signal input terminal is set to a reset potential corresponding to the reset signal, and a second electrode of the first capacitor that is connected to the control terminal is set to a potential of the control terminal when the reset current flows between the first and second terminals, and during the write period, the first electrode is set to a potential corresponding to the video signal.

According to a fourth aspect of the present invention, there is provided a display comprising pixels arranged in a matrix, each of the pixels comprising a voltage signal input terminal to which a voltage signal is supplied, a drive control element including a first terminal connected to a first power supply terminal, a control terminal, and a second terminal that outputs a current corresponding to a voltage between the first terminal and the control terminal, a first capacitor connected between the voltage signal input terminal and the control terminal, a current signal input terminal to which a current signal is supplied, a first switch connected between the current signal input terminal and the control terminal, a second switch connected between the current signal input terminal and the second terminal, an output control switch whose input terminal is connected to the second terminal, and a display element connected between a second power supply terminal and an output terminal of the output control switch, wherein the display changes a write operation between first and second write operations on the basis of a gray level to be displayed, the first write operation includes setting the voltage signal input terminal to a first potential, and opening the output control switch and closing the first and second switches to supply a current as a video signal between the first and second terminals, and the second write operation includes setting the voltage signal input terminal to a second potential, and opening the output control switch and closing the first and second switches to supply a current as a reset signal between the first and second terminals, subsequently opening the first switch, and then setting the voltage signal input terminal to a potential corresponding to the video signal.

According to a fifth aspect of the present invention, there is provided a display comprising pixels arranged in a matrix, each of the pixels comprising a voltage signal input terminal to which a voltage signal is supplied, a drive control element including a first terminal connected to a first power supply terminal, a control terminal, and a second terminal that outputs a current corresponding to a voltage between the first terminal and the control terminal, a first capacitor connected between the voltage signal input terminal and the control terminal, a current signal input terminal to which a current signal is supplied, a first switch connected between the current signal input terminal and the control terminal, a second switch connected between the current signal input terminal and the second terminal, an output control switch whose input terminal is connected to the second terminal, and a display element connected between a second power supply terminal and an output terminal of the output control switch, wherein a write operation of the display includes setting the voltage signal input terminal to a first potential, and opening the output control switch and closing the first and second switches to supply a current as a video signal between the first and second terminals, subsequently opening the first switch, and simultaneously or since then setting the voltage signal input terminal to a second potential different from the first potential.

According to a sixth aspect of the present invention, there is provided an active matrix substrate on which a display element is to be formed, comprising a voltage signal input terminal to which a voltage signal is supplied, a drive control element including a first terminal connected to a first power supply terminal, a control terminal, and a second terminal that outputs a current corresponding to a voltage between the first terminal and the control terminal, a first capacitor connected between the voltage signal input terminal and the control terminal, a current signal input terminal to which a current signal is supplied, a first switch connected between the current signal input terminal and the control terminal, a second switch connected between the current signal input terminal and the second terminal, and an output control switch including an input terminal connected to the second terminal and an output terminal to be connected to the display element.

According to a seventh aspect of the present invention, there is provided a method of driving a display comprising pixels arranged in a matrix, each of the pixels comprising a drive control element including a first terminal connected to a first power supply terminal, a control terminal, and a second terminal that outputs a current corresponding to a voltage between the first terminal and the control terminal, a display element connected between the second terminal and a second power supply terminal, and a capacitor connected between the control terminal and the voltage signal input terminal, comprising supplying a current as a reset signal between the first terminal and the second terminal in a state that the voltage signal input terminal is set to a reset potential, the display element is disconnected from the second terminal, and the control terminal is connected to an outside of the pixel, subsequently disconnecting the control terminal from the outside of the pixel, and then setting the voltage signal input terminal to a potential corresponding to the video signal.

According to an eighth aspect of the present invention, there is provided a method of driving a display comprising pixels arranged in a matrix, each of the pixels comprising a drive control element including a first terminal connected to a first power supply terminal, a control terminal, and a second terminal that outputs a current corresponding to a voltage between the first terminal and the control terminal, a display element connected between the second terminal and a second power supply terminal, and a capacitor connected between the control terminal and the voltage signal input terminal, comprising changing a write operation between first and second write operations on the basis of a gray level to be displayed, wherein the first write operation includes supplying a current as a video signal between the first and second terminals in a state that the voltage signal input terminal is set to a first potential, the display element is disconnected from the second terminal, and the control terminal is connected to an outside of the pixel, and the second write operation includes supplying a current as a reset signal between the first and second terminals in a state that the voltage signal input terminal is set to a second potential, the display element is disconnected from the second terminal, and the control terminal is connected to the outside of the pixel, subsequently disconnecting the control terminal from the outside of the pixel, and then setting the voltage signal input terminal to a potential corresponding to the video signal.

According to a ninth aspect of the present invention, there is provided a method of driving a display comprising pixels arranged in a matrix, each of the pixels comprising a drive control element including a first terminal connected to a first power supply terminal, a control terminal, and a second terminal that outputs a current corresponding to a voltage between the first terminal and the control terminal, a display element connected between the second terminal and a second power supply terminal, and a capacitor connected between the control terminal and the voltage signal input terminal, comprising setting the voltage signal input terminal to a first potential, and opening the output control switch and closing the first and second switches to supply a current as a video signal between the first and second terminals, subsequently opening the first switch, and simultaneously or since then setting the voltage signal input terminal to a second potential different from the first potential.

DETAILED DESCRIPTION OF THE INVENTION

Figure 1:
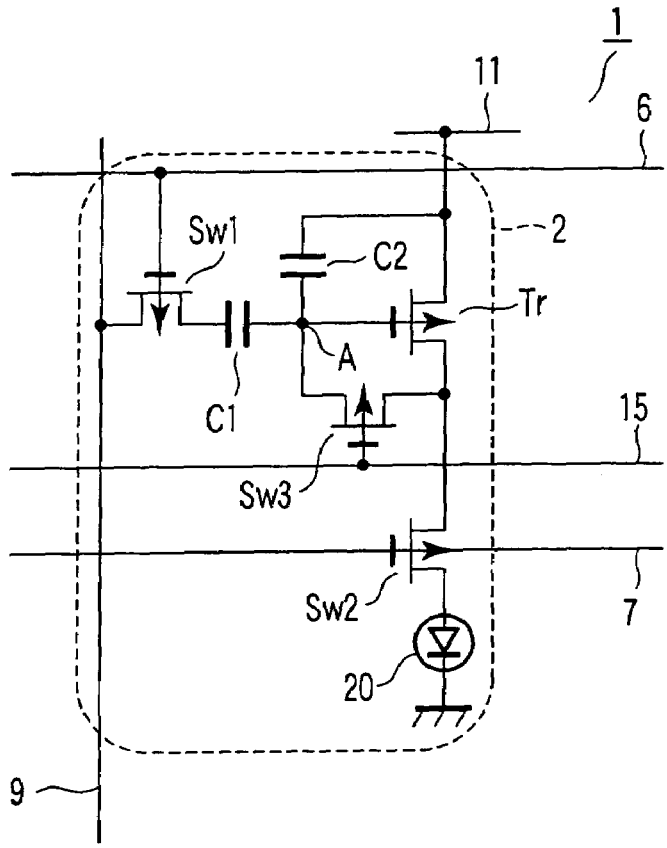
FIG. 1 is an equivalent circuit diagram of an organic EL display using a threshold value cancel circuit.
Figure 2:
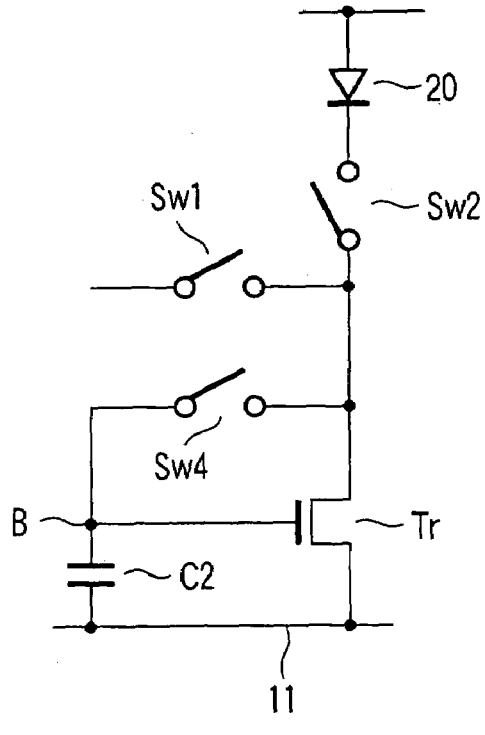
FIG. 2 is an equivalent circuit diagram of an organic EL display using a current copy circuit.

Several embodiments of the present invention will be described below in detail with reference to the accompanying drawings. The same reference numerals denote the same or similar constituent elements throughout the drawings, and a repetitive description thereof will be omitted.

Figure 3:
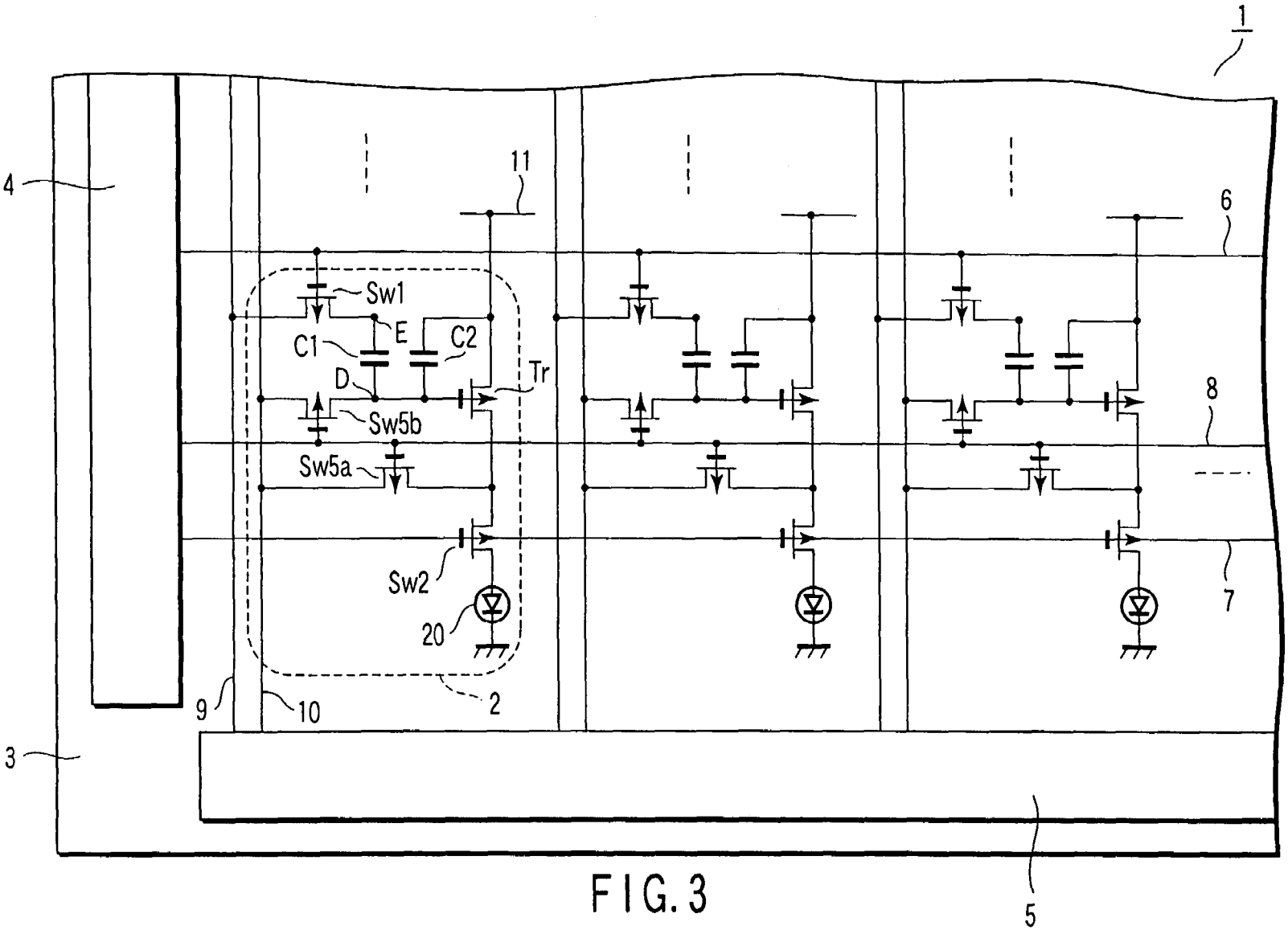
FIG. 3 is a plan view schematically showing a display according to the first embodiment of the present invention.

FIG. 3 is a plan view schematically showing a display according to the first embodiment of the present invention. A display 1 is, e.g., an organic EL display and includes a plurality of pixels 2. The pixels 2 are arranged in a matrix on a substrate 3.

A scan signal line driver 4 and video signal line driver 5 are also arranged on the substrate 3. The video signal line driver 5 constitutes at least part of a current signal supply circuit. The video signal line driver 5 also constitutes at least part of a voltage signal supply circuit. In this example, the video signal line driver 5 incorporates, as the current signal supply circuit, a constant current circuit which outputs a predetermined current, i.e., a reset current.

Scan signal lines 6 to 8 connected to the scan signal line driver 4 run on the substrate 3 in the row direction of the pixels 2. A scan signal is supplied from the scan signal line driver 4 to the scan signal lines 6 to 8 as a voltage signal.

Voltage signal lines 9 which are connected to the video signal line driver 5 and receive a voltage signal and current signal lines 10 which are connected to the video signal line driver 5 and receive a current signal run on the substrate 3 in the column direction of the pixels 2. In this example, the voltage signal lines 9 are video signal lines to which a video signal is supplied from the video signal line driver 5. On the other hand, in this example, the current signal lines 10 are the reset signal lines 10 connected to the constant current circuit incorporated in the video signal line driver 5.

A power supply line 11 is also formed on the substrate 3.

Each pixel 2 includes a drive transistor Tr, a selection switch Sw1, an output control switch Sw2, correction signal supply control switches Sw5*a* and Sw5*b*, capacitors C1 and C2, and a display element 20. The switches Sw1, Sw2, Sw5*a*, and Sw5*b* are, e.g., thin film transistors (TFTs). The capacitors C1 and C2 are, e.g., thin film capacitors. The drive transistor Tr is assumed to include a TFT.

The display element 20 includes an anode and a cathode, which face each other, and an active layer whose optical characteristics change depending on the current that flows between the anode and the cathode. For example, the display element 20 is an organic EL element including a light-emitting layer as the active layer. For example, the anode is arranged as a lower electrode and connected to the drive transistor Tr via the output control switch Sw2. On the other hand, the cathode is arranged as, e.g., an upper electrode which faces the lower electrode via the active layer.

The drive transistor Tr is, e.g., a p-channel TFT. The gate is connected to one electrode of the capacitor C1. When the drive transistor Tr is a p-channel TFT, the source is connected to the power supply line 11, and the drain is connected to the lower electrode of the organic EL element 20 via the output control switch Sw2.

The input terminal of the selection switch Sw1 is connected to the video signal line 9. The output terminal is connected to the gate of the drive transistor Tr via the capacitor C1. The switching operation of the selection switch Sw1 is controlled by a scan signal supplied from the scan signal line 6. The selection switch Sw1 is, e.g., a p-channel TFT. In this case, the gate is connected to the scan signal line 6. The source is connected to the video signal line 9. The drain is connected to the other electrode of the capacitor C1.

The output control switch Sw2 is connected between the drive transistor Tr and the organic EL element 20. The switching operation of the output control switch Sw2 is controlled by a scan signal supplied from the scan signal line 7. The output control switch Sw2 is, e.g., a p-channel TFT. In this case, the gate is connected to the scan signal line 7. The source and drain are connected to the drive transistor Tr and the organic EL element 20, respectively.

The correction signal supply control switch Sw5*a* is connected between the reset signal line 10 and the gate of the drive transistor Tr. The switching operation of the switch Sw5*a* is controlled by a scan signal supplied from the scan signal line 8. The correction signal supply control switch Sw5*a* is, e.g., a p-channel TFT. In this case, the gate is connected to the scan signal line 8. The source and drain are connected to the gate of the drive transistor Tr and the reset signal line 10, respectively.

The correction signal supply control switch Sw5*b* is connected between the reset signal line 10 and the drain of the drive transistor Tr. The switching operation of the switch Sw5*b* is controlled by a scan signal supplied from the scan signal line 8. The correction signal supply control switch Sw5*b* is, e.g., a p-channel TFT. In this case, the gate is connected to the scan signal line 8. The source and drain are connected to the drain of the drive transistor Tr and the reset signal line 10, respectively.

The correction signal supply control switches Sw5*a* and Sw5*b* form a correction signal supply control unit. This correction signal supply control unit may have a structure other than that shown in FIG. 3 if connection/disconnection between the drain of the drive transistor Tr, the gate of the drive transistor Tr, and the reset signal line 10 can be switched. For example, referring to FIG. 3, the switching operations of the correction signal supply control switches Sw5*a* and Sw5*b* are controlled by one scan signal line 8. Instead, the switching operations may be controlled by two scan signal lines. Referring to FIG. 3, the correction signal supply control switch Sw5*a* is connected between the reset signal line 10 and the drain of the drive transistor Tr. Instead, the correction signal supply control switch Sw5*a* may be connected between the drain of the drive transistor Tr and the gate of the drive transistor Tr.

The capacitor C1 is connected between the selection switch Sw1 and the gate of the drive transistor Tr. The capacitor C2 is connected between the source of the drive transistor Tr and the gate of the drive transistor Tr. The capacitances of the capacitors C1 and C2 need not be equal. However, they are assumed to be equal here for the sake of simplicity. The capacitor C2 may be connected between, e.g., the gate of the drive transistor Tr and a constant potential terminal insulated from the source of the drive transistor Tr instead of between the source of the drive transistor Tr and the gate of the drive transistor Tr. More specifically, the capacitor C2 need not always be connected between the gate and source of the drive transistor Tr if the capacitor C2 has one terminal connected to the gate of the drive transistor Tr and can hold the gate-to-source voltage of the drive transistor Tr in correspondence with a video signal.

In the display 1, the substrate 3, scan signal lines 6, voltage signal lines 9, current signal lines 10, power supply line 11, switches Sw1, Sw2, Sw5*a*, and Sw5*b*, drive transistors Tr, and capacitors C1 and C2 form an active matrix substrate. This active matrix substrate can also include the scan signal line driver 4 and video signal line driver 5. This active matrix substrate can also include one electrode of each display element.

In this embodiment, the display 1 shown in FIG. 3 is driven by, e.g., a method to be described below.

Figure 4:
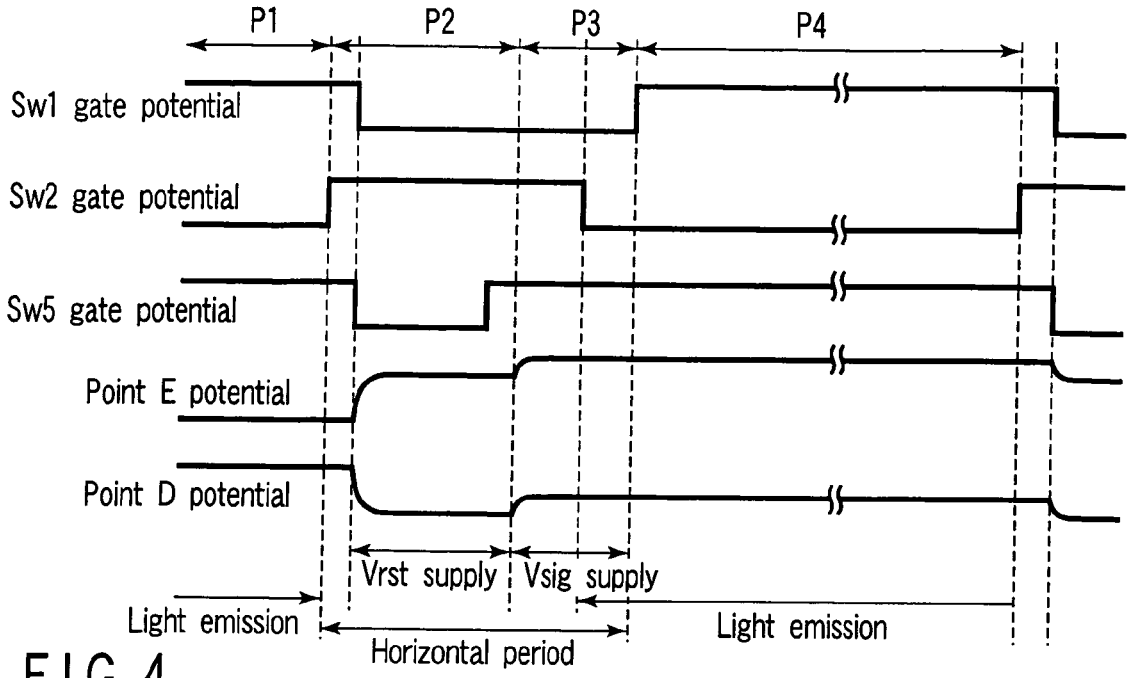
FIG. 4 is a timing chart schematically showing an example of the method of driving the display shown in FIG. 3.
Figure 5:
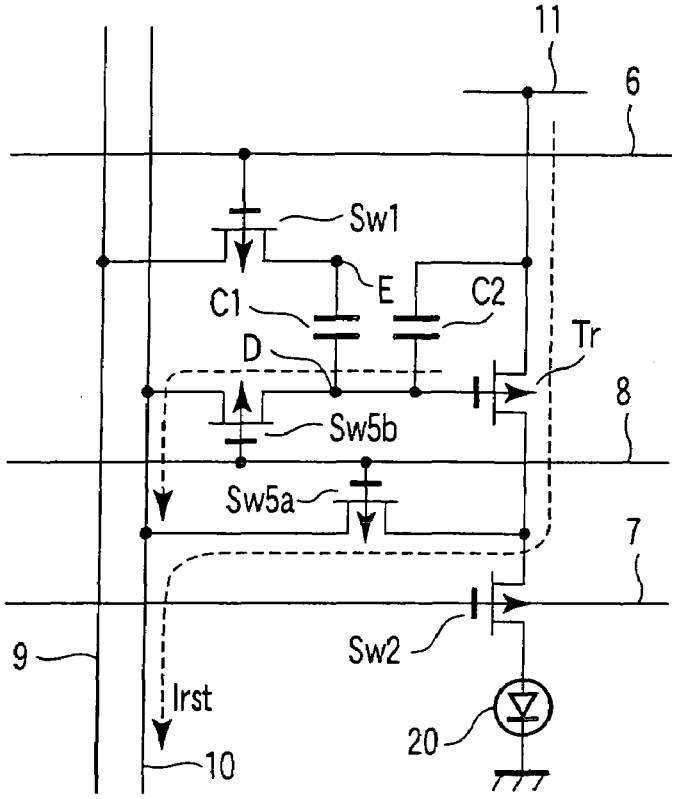
FIG. 5 is a view showing the direction of a current which flows when the display shown in FIG. 3 is driven by the method shown in FIG. 4.
Figure 6:
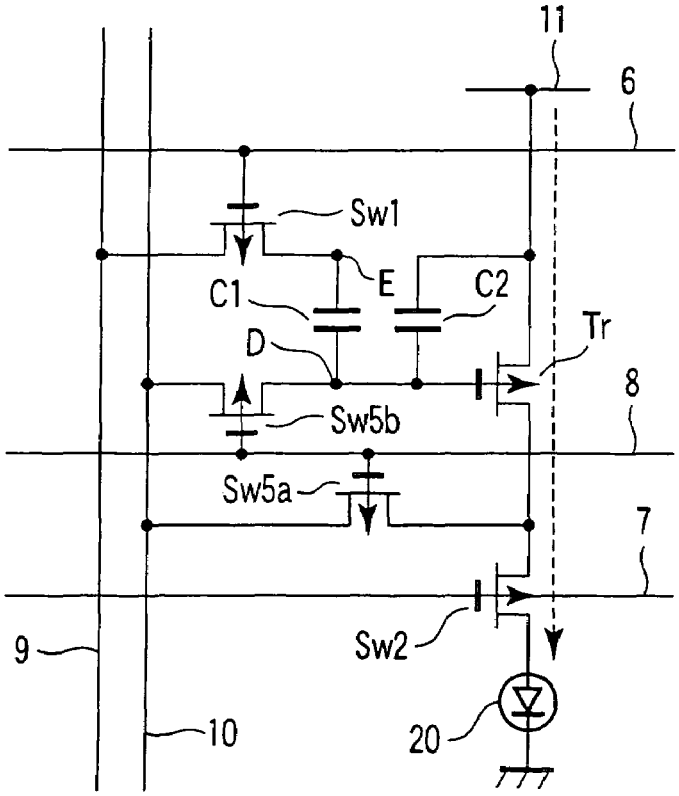
FIG. 6 is a view showing the direction of a current which flows when the display shown in FIG. 3 is driven by the method shown in FIG. 4.

FIG. 4 is a timing chart schematically showing an example of the driving method of the display 1 shown in FIG. 3. FIGS. 5 and 6 are views showing the direction of a current which flows when the display 1 shown in FIG. 3 is driven by the method shown in FIG. 4. Referring to FIG. 4, assume that all the switches Sw1, Sw2, Sw5*a*, and Sw5*b* are p-channel TFTs. "Sw5 gate potential" indicates the gate potential of the switches Sw5*a* and Sw5*b*. "Point D potential" indicates the gate potential of the drive transistor Tr. Referring to FIGS. 5 and 6, dotted arrows indicate the flowing directions of currents.

In the driving method shown in FIG. 4, one horizontal period includes a correction period P2 and a write period P3. One vertical period includes the correction period P2, the write period P3, and a holding period P4. A period P1 indicates a holding period one vertical period before. At this time, the selection switch Sw1 and correction signal supply control switches Sw5*a* and Sw5*b* are open. The output control switch Sw2 is closed. The drive transistor Tr is outputting a drive current corresponding to the magnitude of a video signal Vsig written one frame before. The organic EL element 20 is emitting light.

During the correction period P2, first, the output control switch Sw2 is closed while keeping the selection switch Sw1 and correction signal supply control switches Sw5*a* and Sw5*b* open. Next, the correction signal supply control switches Sw5*a* and Sw5*b* are closed, and the selection switch Sw1 is closed to supply a reset signal Vrst to a node E as a voltage signal input terminal.

In this state, as shown in FIG. 5, a predetermined constant current, i.e., a reset current Irst is supplied between the source and drain of the drive transistor Tr. Accordingly, a current flows between the reset signal line 10 and the gate of the drive transistor Tr. As a result, the potential of a node D changes as shown in FIG. 4. More specifically, a correction signal Vcrct on which the element characteristics such as the threshold value, mobility, and dimensions are reflected is supplied to the node D.

In this way, charges corresponding to the reset signal Vrst and correction signal Vcrct are accumulated in each electrode of the capacitor C1. Then, the correction signal supply control switches Sw5*a* and Sw5*b* are opened to end the correction period P2.

When the magnitude of the video signal Vsig equals the reset signal Vrst, the drive current output from the drive transistor Tr equals the reset current Irst. The effect for correcting the characteristic of the drive transistor Tr is maximized when the magnitude of the video signal Vsig equals the reset signal Vrst. Hence, the reset current Irst may be set to be almost equal to the drive current corresponding to the gray level at which the maximum effect should be obtained.

During the write period P3, the selection switch Sw1 is continuously kept closed, and the output control switch Sw2 and correction signal supply control switches Sw5*a* and Sw5*b* are kept open. During the period P3, first, the video signal Vsig is supplied to the node E as an input terminal in this state. Accordingly, as shown in FIG. 4, the potential of the node D changes along with the change in potential of the node E. Next, the output control switch Sw2 is closed. Accordingly, a current flows to the organic EL element 20, as shown in FIG. 6. The organic EL element 20 emits light at a luminance corresponding to the video signal Vsig. After that, the selection switch Sw1 is set in the OFF state to end the write period P3.

During the holding period P4, the selection switch Sw1 and correction signal supply control switches Sw5*a* and Sw5*b* are open, and the output control switch Sw2 is kept closed. For this reason, the potential of the node D is maintained almost at a predetermined level. The organic EL element 20 continuously emits light at the luminance corresponding to the video signal Vsig.

In this method, as described above, the characteristics are corrected by using the correction signal Vcrct on which the element characteristics of the drive transistor Tr, i.e., the threshold value, mobility, and dimensions of the drive transistor Tr are reflected. Additionally, in this method, the correction signal Vcrct obtained in association with a given transistor is used to correct that transistor itself. For this reason, according to the above method, the influence of the variation in characteristic of the transistor on the drive current can very effectively be reduced.

In this method, the constant current circuit capable of supplying the constant current Irst is necessary, though no constant current circuit capable of freely changing the current value is necessary. For this reason, the above-described method is very advantageous for cost reduction of the display 1.

Figure 7:
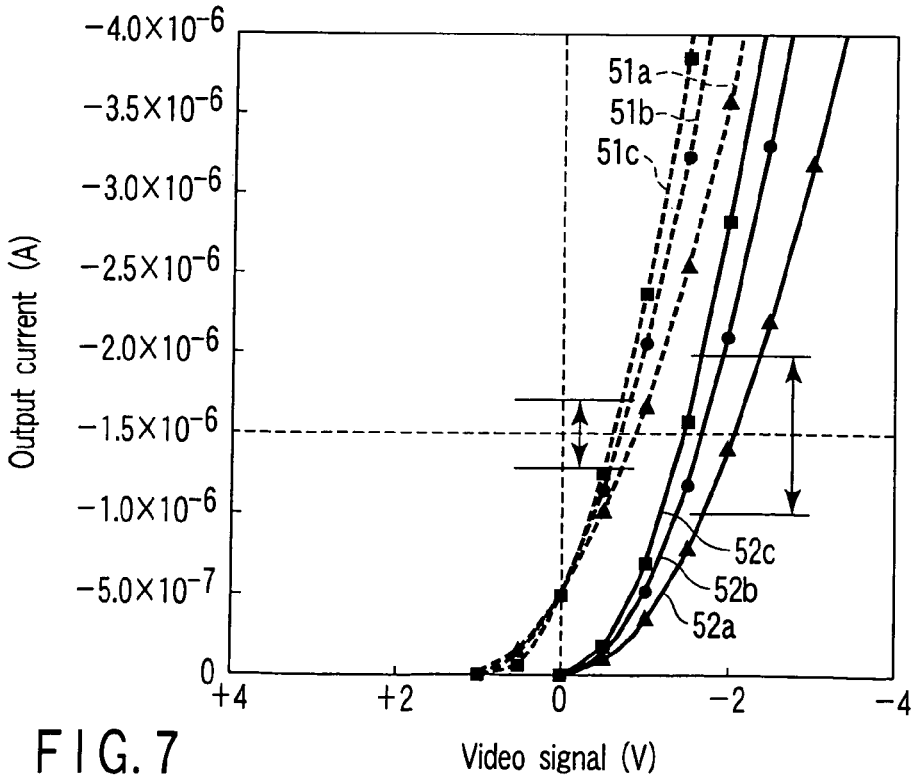
FIG. 7 is a graph showing an example of an effect obtained by the method according to the first embodiment of the present invention.

FIG. 7 is a graph showing an example of the effect obtained by the method according to the first embodiment of the present invention. Referring to FIG. 7, the abscissa represents the video signal Vsig supplied to the electrode of the capacitor C1 on the side of the selection switch Sw1 during the write period. The ordinate represents the current which flows between the source and drain of the drive transistor Tr during the holding period, i.e., the output current or drive current. Curves 51*a* to 51*c* in FIG. 7 indicate data obtained when the display 1 shown in FIG. 3 is driven by the method described with reference to FIG. 4. Curves 52*a* to 52*c* in FIG. 7 indicate data obtained when the display 1 shown in FIG. 1 is driven by the method described in association with it.

In obtaining the data indicated by the curves 51*a* to 51*c* and curves 52*a* to 52*c*, the channel width of the drive transistor Tr was 5 μm, and the channel length was 20 μm. In obtaining the data indicated by the curves 51*a* and 52*a*, the mobility of the drive transistor Tr was 100 $cm^2/V \cdot S$. In obtaining the data indicated by the curves 51*b* and 52*b*, the mobility of the drive transistor Tr was 150 $cm^2/V \cdot S$. In obtaining the data indicated by the curves 51*c* and 52*c*, the mobility of the drive transistor Tr was 200 $cm^2/V \cdot S$. In obtaining the data indicated by the curves 51*a* to 51*c* and curves 52*a* to 52*c*, the reset potential Vrst was 0V, and the reset current Irst was 0.5 μA.

As is apparent from comparison between the curves 51*a* to 51*c* and the curves 52*a* to 52*c* shown in FIG. 7, according to the method of this embodiment, the influence of the variation in mobility of the drive transistor Tr on the output current is suppressed as compared to the method described with reference to FIG. 1. For example, consider the video signal corresponding to the output current of 1.5 μA in the display 1 in which the mobility of the drive transistor Tr is 150 $cm^2/V \cdot S$. The influence of the variation in mobility of the drive transistor Tr on the output current is ½ or less in the method of this embodiment as compared to the method described with reference to FIG. 1. As described above, according to this embodiment, the influence of the variation in characteristics of the transistor can very effectively be reduced.

The second embodiment of the present invention will be described next.

In the first embodiment, the characteristics of the drive transistor Tr are corrected for each pixel row. More specifically, characteristic correction is executed simultaneously for all the pixels 2 included in a selected pixel row during each horizontal period. In the second embodiment, however, pixels 2 included in a selected pixel row during each horizontal period are classified into a plurality of groups, and the characteristic correction operation is done sequentially for the pixel groups. An example will be described below, in which the correction operation is sequentially executed for each pixel 2.

Figure 8:
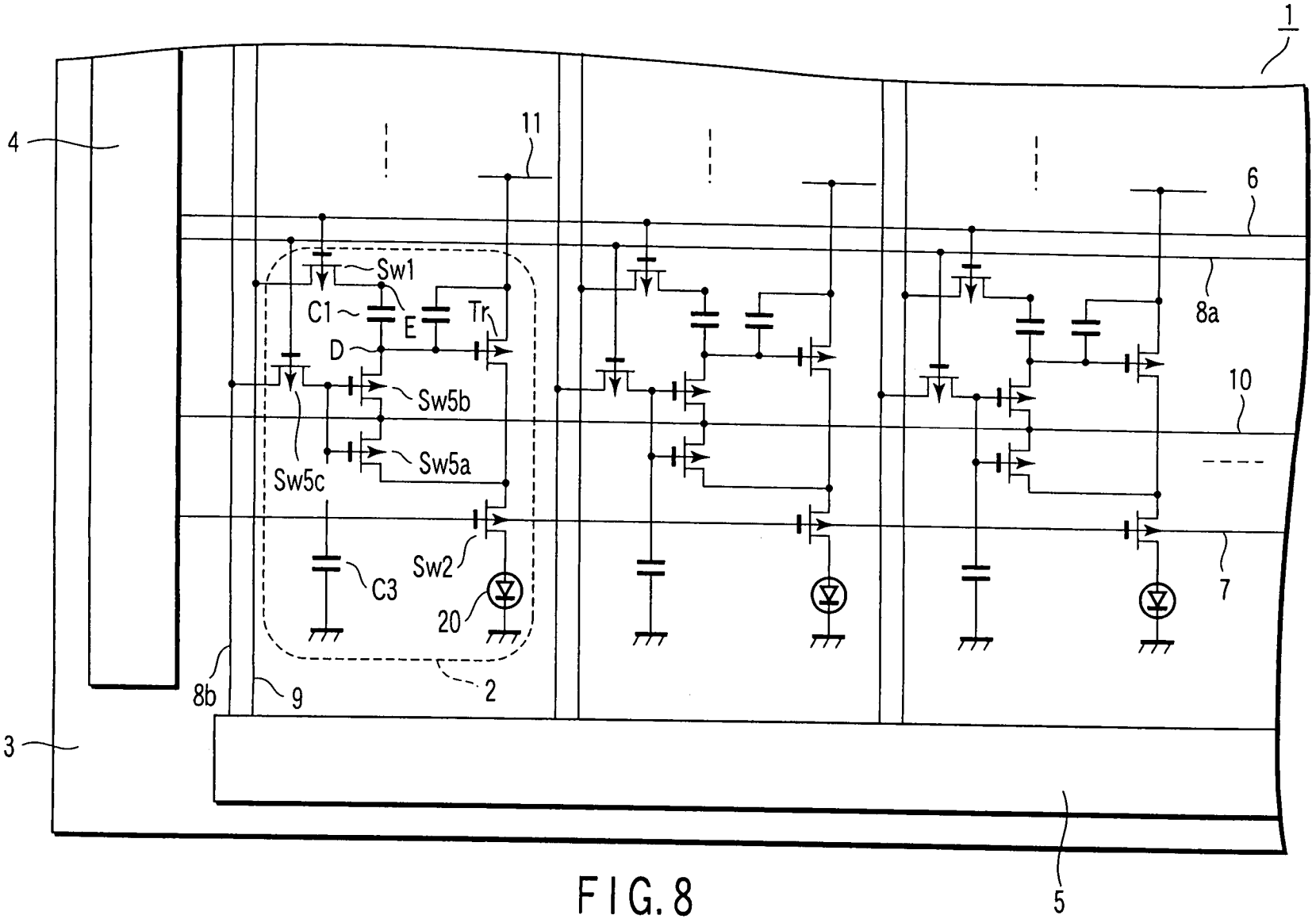
FIG. 8 is a plan view schematically showing a display according to the second embodiment of the present invention.

FIG. 8 is a plan view schematically showing a display according to the second embodiment of the present invention. A display 1 is, e.g., an organic EL display and includes the plurality of pixels 2. The pixels 2 are arranged in a matrix on a substrate 3.

A scan signal line driver 4 and video signal line driver 5 are arranged on the substrate 3. In this example, the scan signal line driver 4 incorporates, as a current signal supply circuit, a constant current circuit which outputs a predetermined current, i.e., a reset current.

Scan signal lines 6, 7, and 8*a* connected to the scan signal line driver 4 and reset signal lines 10 connected to the constant current circuit incorporated in the scan signal line driver 4 run on the substrate 3 in the row direction of the pixels 2. A scan signal is supplied from the scan signal line driver 4 to the scan signal lines 6, 7, and 8*a* as a voltage signal. On the other hand, the reset signal line 10 is a current signal line to which a reset current is supplied from the scan signal line driver 4.

Video signal lines 9 and control signal lines 8*b*, which are connected to the video signal line driver 5, run on the substrate 3 in the column direction of the pixels 2. In addition, a power supply line 11 is formed on the substrate 3. A video signal is supplied from the video signal line driver 5 to the video signal lines 9 as a voltage signal. A control signal is supplied from the video signal line driver 5 to the control signal lines 8*b* as a voltage signal.

Each pixel 2 includes a drive transistor Tr, a selection switch Sw1, an output control switch Sw2, correction signal supply control switches Sw5*a*, Sw5*b*, and Sw5*c*, capacitors C1, C2, and C3, and a display element 20. The switches Sw1, Sw2, Sw5*a*, Sw5*b*, and Sw5*c* are, e.g., TFTs. The capacitors C1, C2, and C3 are, e.g., thin film capacitors. The drive transistor Tr is assumed to include a TFT.

The correction signal supply control switch Sw5*c* is connected between the control signal line 8*b* and each gate of the correction signal supply control switches Sw5*a* and Sw5*b*. The switching operation of the switch Sw5*c* is controlled by a scan signal supplied from the scan signal line 8*a*. That is, in this embodiment, the correction signal supply control switches Sw5*a*, Sw5*b*, and Sw5*c* form a correction signal supply control unit. The capacitor C3 is connected between the gates of the switches Sw5*a* and Sw5*b* and a constant voltage source and, in this example, GND.

The correction signal supply control switch Sw5*c* is, e.g., a p-channel TFT. In this case, the gate of the switch Sw5*c* is connected to the scan signal line 8*a*. The source and drain are connected to the control signal line 8*b* and each gate of the switches Sw5*a* and Sw5*b*, respectively. With the correction signal supply control switches Sw5, pixels to be subjected to the correction operation can sequentially be selected.

In the display 1, the substrate 3, scan signal lines 6, 7, and 8*a*, control signal lines 8*b*, voltage signal lines 9, current signal lines 10, power supply line 11, switches Sw1, Sw2, Sw5*a*, Sw5*b*, and Sw5*c*, drive transistors Tr, and capacitors C1, C2, and C3 form an active matrix substrate. This active matrix substrate can also include the scan signal line driver 4 and video signal line driver 5. This active matrix substrate can also include one electrode of each display element.

As described above, in this embodiment, the reset signal line 10 connected to the constant current circuit is arranged almost parallel to the scan signal line 6. In addition, with the scan signal line 8*a* and control signal line 8*b*, which run in the horizontal and vertical directions, and the correction signal supply control switch Sw5*c*, the switching operations of the correction signal supply control switches Sw5*a* and Sw5*b* can be controlled for each pixel 2. For this reason, the same correction as that described in the first embodiment can be executed sequentially for the pixels 2 in each row. Hence, all the pixels 2 included in one row can be corrected by, e.g., one constant current circuit.

In this method, when an appropriate design is employed, the constant current circuit used for characteristic correction of the pixels 2 included in a row can be used even for characteristic correction of the pixels 2 included in another row.

In this method, all the pixels 2 which are not performing the correction operation are disconnected from the reset signal lines 10. Hence, the load on the constant current circuit or the power consumption of the constant current circuit does not increase.

The third embodiment of the present invention will be described next.

Figure 9:
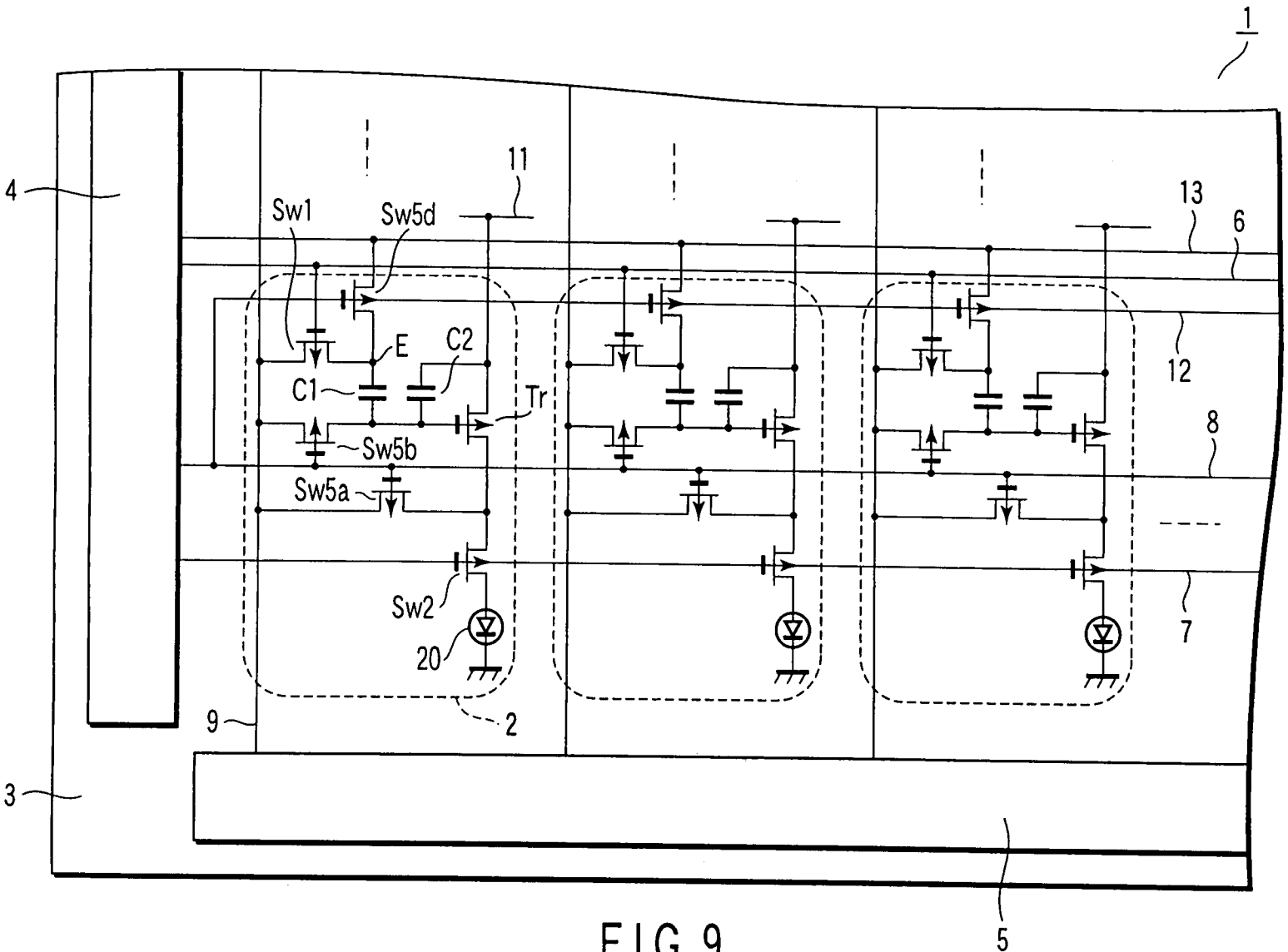
FIG. 9 is a plan view schematically showing a display according to the third embodiment of the present invention.
Figure 10:
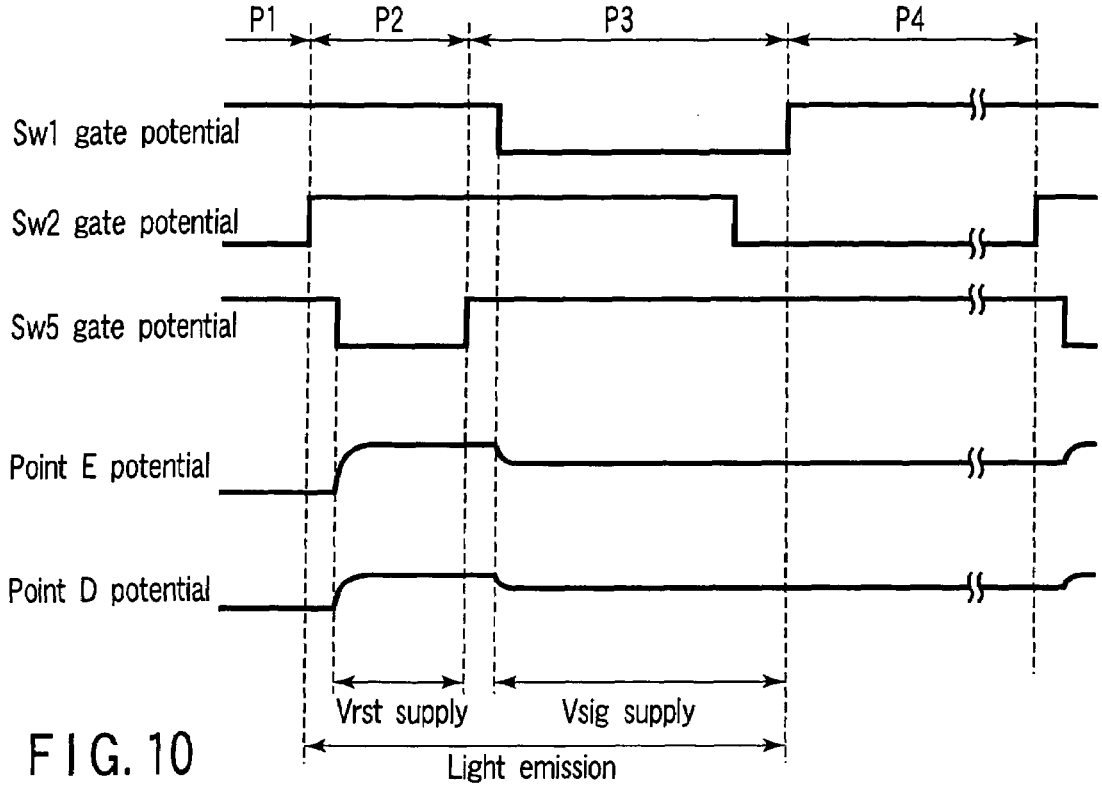
FIG. 10 is a timing chart schematically showing an example of the method of driving the display shown in FIG. 9.

FIG. 9 is a plan view schematically showing a display according to the third embodiment of the present invention. FIG. 10 is a timing chart schematically showing an example of the driving method of a display 1 shown in FIG. 9. Referring to FIG. 10, "Sw5 gate potential" indicates the gate potential of switches Sw5*a*, Sw5*b*, and Sw5*d*.

The display 1 is, e.g., an organic EL display and includes a plurality of pixels 2. The pixels 2 are arranged in a matrix on a substrate 3.

A scan signal line driver 4 and video signal line driver 5 are arranged on the substrate 3. In this example, the video signal line driver 5 incorporates a constant current circuit.

Scan signal lines 6 to 8 and reset signal supply lines 13, which are connected to the scan signal line driver 4, run on the substrate 3 in the row direction of the pixels 2. A control signal line 12 which runs in the row direction of the pixels 2 is connected to each scan signal line 8.

Video signal lines 9 connected to the video signal line driver 5 run on the substrate 3 in the column direction of the pixels 2. In addition, a power supply line 11 is formed on the substrate 3.

The video signal line driver 5 selects one of the constant current circuit and the circuit which outputs a video signal as a voltage signal and connects the video signal line 9 to the selected circuit. That is, in this example, the video signal line 9 is a voltage/current signal line.

Each pixel 2 includes a drive transistor Tr, a selection switch Sw1, an output control switch Sw2, the correction signal supply control switches Sw5*a*, Sw5*b*, and Sw5*d*, capacitors C1 and C2, and a display element 20. The switches Sw1, Sw2, Sw5*a*, Sw5*b*, and Sw5*d* are, e.g., TFTs. The capacitors C1 and C2 are, e.g., thin film capacitors. The drive transistor Tr is assumed to include a TFT.

The correction signal supply control switch Sw5*d* is connected between the reset signal supply line 13 and the electrode of the capacitor C1 on the side of the selection switch Sw1. The switching operation of the switch Sw5*d* is controlled by a scan signal supplied from the scan signal line 8 through the control line 12. In this embodiment, the correction signal supply control switches Sw5*a*, Sw5*b*, and Sw5*d* form a correction signal supply control unit.

The correction signal supply control switch Sw5*d* is, e.g., a p-channel TFT. In this case, the gate of the switch Sw5*d* is connected to the scan signal line 8. The source and drain are connected to the reset signal supply line 13 and the electrode of the capacitor C1 on the side of the selection switch Sw1, respectively.

In the display 1, the substrate 3, scan signal lines 6 to 8 and 13, voltage/current signal lines 9, power supply line 11, control signal lines 12, switches Sw1, Sw2, Sw5*a*, Sw5*b*, and Sw5*d*, drive transistors Tr, and capacitors C1 and C2 form an active matrix substrate. This active matrix substrate can also include the scan signal line driver 4 and video signal line driver 5. This active matrix substrate can also include one electrode of each display element.

In this embodiment, a reset signal Vrst is supplied from the reset signal supply line 13 to a node E through the correction signal supply control switch Sw5*d*. In addition, a reset current Irst can flow to the video signal line 9. That is, the video signal line 9 is used for both supply of a video signal Vsig and supply of the reset current Irst. Since the reset signal line 10 formed independently of the video signal line 9 is unnecessary, the number of wiring lines which run almost parallel to the video signal lines 9 can be decreased.

The fourth embodiment of the present invention will be described next.

In the first to third embodiments, a voltage signal is supplied as a video signal. In the fourth embodiment, however, an arrangement capable of supplying both a voltage signal corresponding to a video signal and a current signal corresponding to a video signal is employed.

Figure 11:
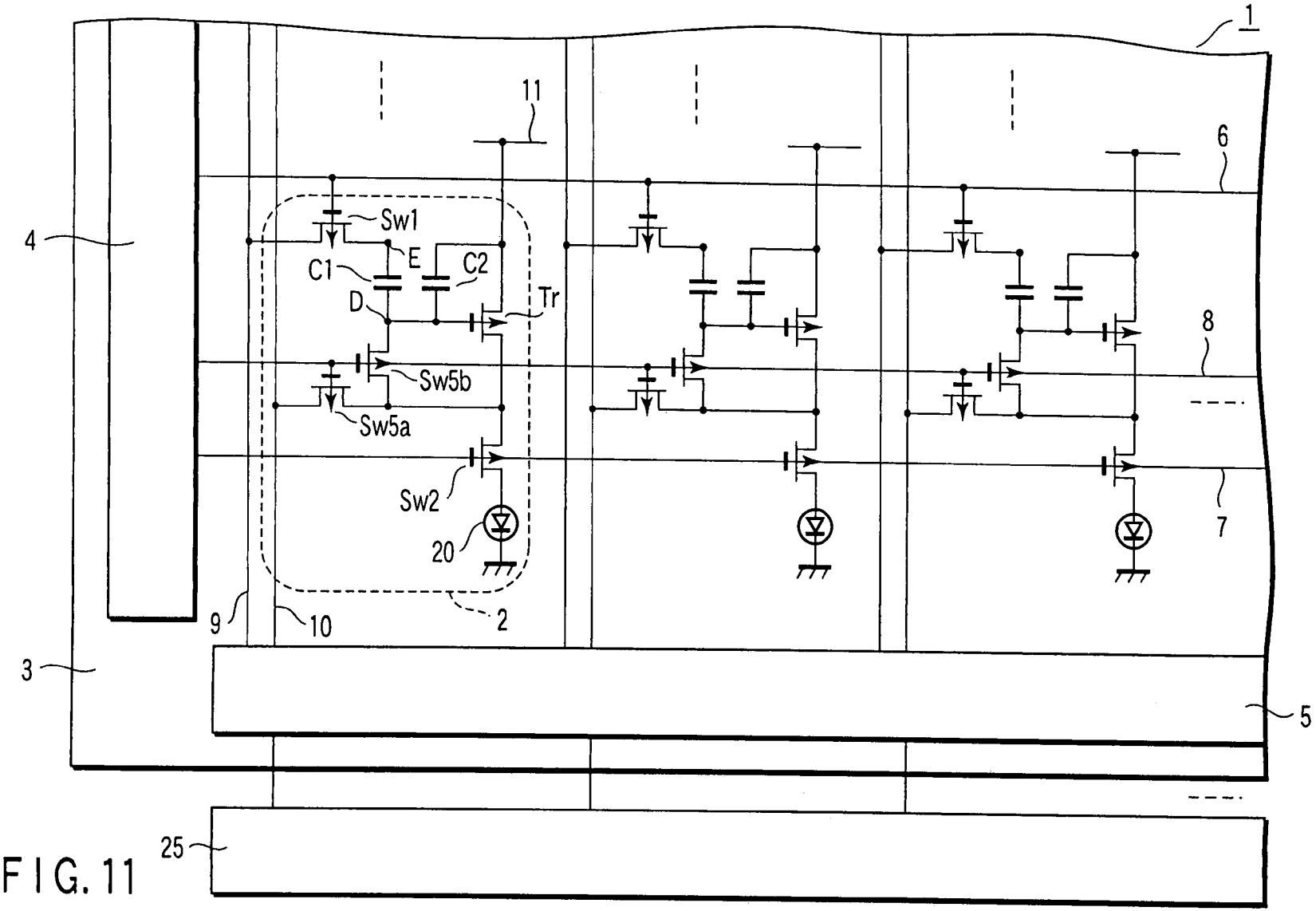
FIG. 11 is a plan view schematically showing a display according to the fourth embodiment of the present invention.

FIG. 11 is a plan view schematically showing a display according to the fourth embodiment of the present invention. A display 1 shown in FIG. 11 is, e.g., an organic EL display. The display 1 has the same structure as that of the display 1 shown in FIG. 3 except that the following arrangement is employed.

The display 1 shown in FIG. 11 includes a voltage/current source 25 connected to a video signal line driver 5. The voltage/current source 25 incorporates a voltage source capable of changing the output voltage and a current source capable of changing the output current. In the display shown in FIG. 11, a correction signal supply control switch Sw5*b* is connected between the gate and drain of a drive transistor Tr.

The switch Sw5*b* may be connected between a reset signal line 10 and the gate of the drive transistor Tr.

In the display 1, a substrate 3, scan signal lines 6 to 8, voltage signal lines 9, current signal lines 10, power supply line 11, switches Sw1, Sw2, Sw5*a*, and Sw5*b*, drive transistors Tr, and capacitors C1 and C2 form an active matrix substrate. This active matrix substrate can also include a scan signal line driver 4 and the video signal line driver 5. This active matrix substrate can also include one electrode of each display element.

Figure 12:
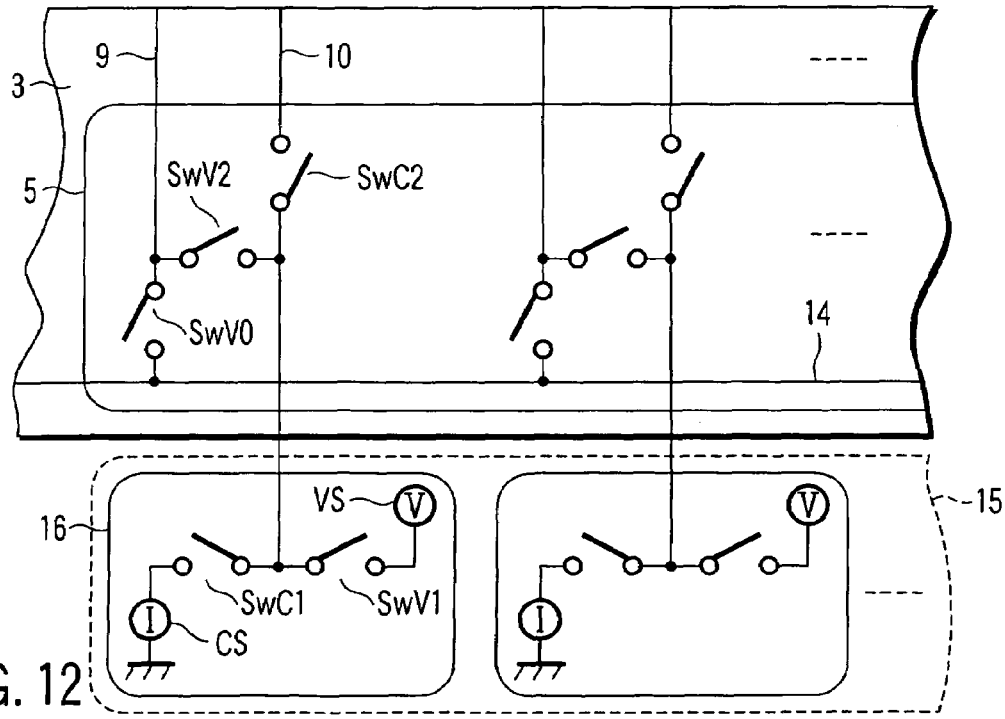
FIG. 12 is an equivalent circuit diagram of a video signal line driver and a voltage/current source, which can be used in the display shown in FIG. 11.

FIG. 12 is an equivalent circuit diagram of the video signal line driver and the voltage/current source, which can be used in the display shown in FIG. 11.

In the circuit shown in FIG. 12, the voltage/current source 25 includes a current source CS, voltage source VS, switch SwC1, and switch SwV1. The switch SwC1 is connected between the current source CS and the output terminal of the voltage/current source 25. The switch SwV1 is connected between the voltage source VS and the output terminal of the voltage/current source 25.

The voltage source VS and current source CS can be formed on one IC (Integrated Circuit) 16. The switch SwC1 and switch SwV1 can also be formed on the IC 16. The voltage/current source 25 can include, e.g., a plurality of ICs 16.

The video signal line driver 5 includes a constant potential line 14, switch SwV0, switch SwV2, and switch SwC2. The constant potential line 14 is set to a predetermined potential of, e.g., 0V. The switch SwV0 is connected between the constant potential line 14 and the voltage signal line 9. The switch SwV2 is connected between the voltage signal line 9 and the output terminal of the voltage/current source 25. The switch SwC2 is connected between the current signal line 10 and the output terminal of the voltage/current source 25.

Figure 13:
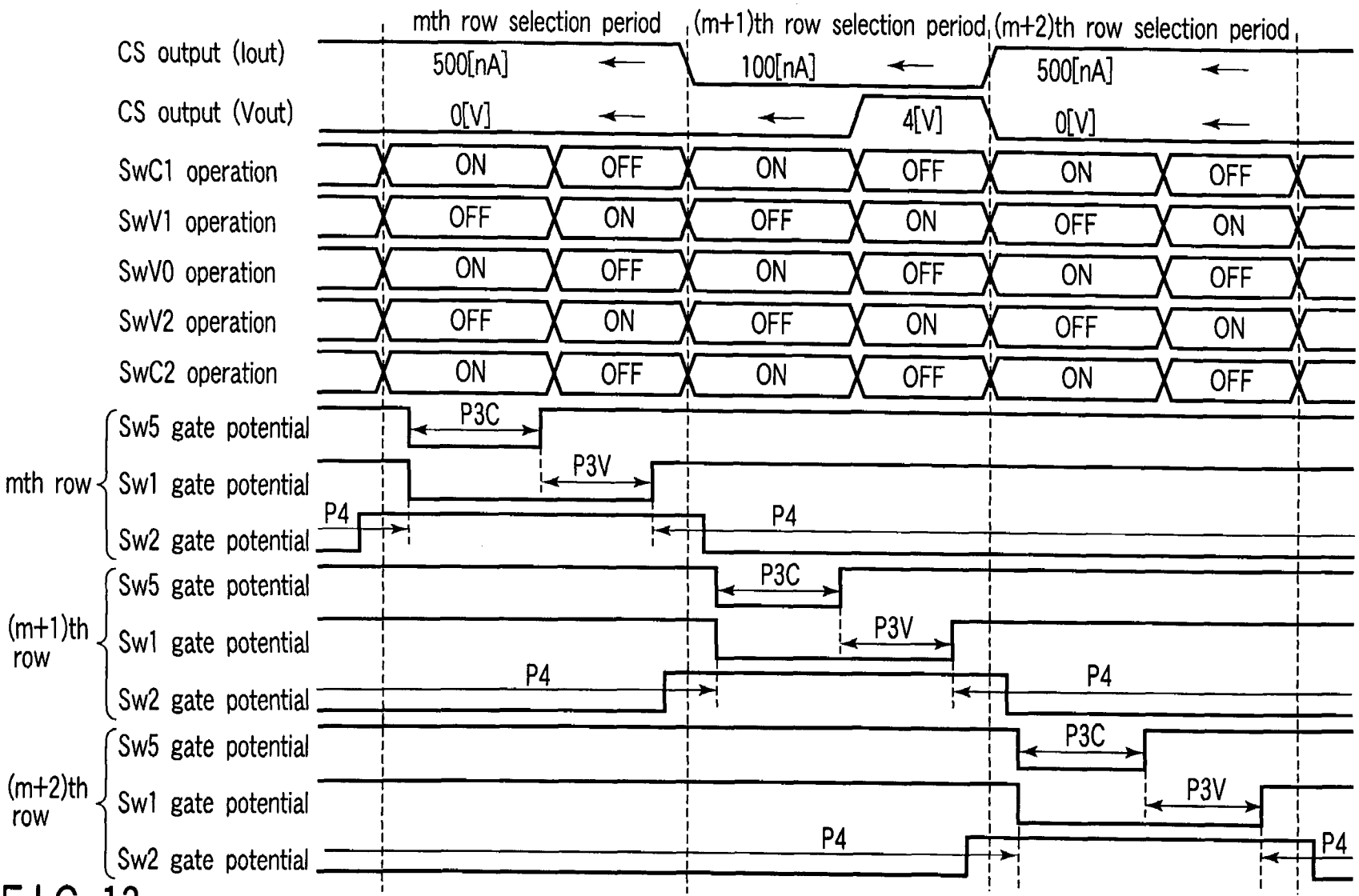
FIG. 13 is a timing chart schematically showing an example of the method of driving the display shown in FIG. 11.

FIG. 13 is a timing chart schematically showing an example of the method of driving the display shown in FIG. 11. In this driving method, one horizontal period includes a first write period P3C and a second write period P3V. One vertical period includes the first write period P3C, second write period P3V, and a holding period P4.

In the method shown in FIG. 13, an output current Iout from the current source CS and an output voltage Vout from the voltage source VS in the case of displaying a brighter gray level differ from those in the case of displaying a darker gray level.

FIG. 13 assumes that, for example, a brighter gray level is displayed by the pixels 2 of the mth and (m+2)th rows, and a darker gray level is displayed by the pixels 2 of the (m+1)th row.

To display a brighter gray level corresponding to a drive current larger than, e.g., 100 nA, the display 1 is driven by, e.g., the following method.

For example, during the period when the pixels 2 of the mth row are selected, i.e., the mth row selection period, the switch Sw2 is opened first. Within the period when the switch Sw2 is open, the first write operation and second write operation are sequentially executed.

During the first write period P3C when the first write operation is executed, the switches SwV0, SwC1, and SwC2 are closed, and the switches SwV1 and SwV2 are opened. More specifically, the voltage source VS is disconnected from the video signal line driver 5. In addition, the constant potential line 14 is connected to the voltage signal line 9, and the current source CS is connected to the current signal line 10. In this state, the switches Sw1, Sw5*a*, and Sw5*b* are closed to set the output current Iout from the current source CS to a current signal Isig of, e.g., 500 nA corresponding to the video signal. Accordingly, the gate-to-source voltage of the drive transistor Tr is set to a value when the current Isig flows between the source and drain. The first write period P3C is ended by opening the switches Sw5*a* and Sw5*b*.

As described above, during the first write period P3C, the voltage source VS is disconnected from the video signal line driver 5. Hence, the potential Vout at the output terminal of the voltage source VS can have any value. For example, the potential Vout at the output terminal of the voltage source VS is set to 0V.

During the second write period P3V next to the first write period P3C, the gate-to-source voltage of the drive transistor Tr, which is set during the first write period P3C, is held. More specifically, the switch Sw5*b* is kept open. For example, during the second write period P3V, the switches SwV0, SwC1, and SwC2 are opened, and the switches Sw1, SwV1, and SwV2 are closed. In this case, for example, the potential Vout at the output terminal of the voltage source VS is set to a predetermined potential of, e.g., 0V. The second write period P3V is ended by opening the switch Sw1.

During the holding period P4 next to the second write period P3V, the switch Sw2 is closed. Accordingly, a current having a magnitude almost equal to the current Isig flows to the display element 20. To execute the write for the next pixel row, the switches SwV0, SwC1, and SwC2 are closed, and the switches SwV1 and SwV2 are opened.

As described above, in the write operation for displaying a brighter gray level, the current signal Isig is supplied between the source and drain of the drive transistor Tr as a video signal. With this operation, the potential of a node D is set to a value corresponding to the video signal. Since the current Isig is sufficiently large, the potential of the node D faithfully reflects the characteristic of the drive transistor Tr. More specifically, according to this embodiment, not only the influence of a threshold value Vth of the drive transistor Tr but also the influence of its mobility and dimensions on the drive current can completely be eliminated.

In the method shown in FIG. 13, to display a darker gray level corresponding to a drive current of, e.g., 100 nA or less, the display 1 is driven by, e.g., the following method.

For example, during the period when the pixels 2 of the (m+1)th row are selected, i.e., the (m+1)th row selection period, the switch Sw2 is opened first, as described about the mth row selection period. Within the period when the switch Sw2 is open, the first write operation and second write operation are sequentially executed.

During the first write period P3C when the first write operation is executed, the switches SwV0, SwC1, and SwC2 are closed, and the switches SwV1 and SwV2 are opened, as described about the mth row selection period. More specifically, the voltage source VS is disconnected from the video signal line driver 5. In addition, the constant potential line 14 is connected to the voltage signal line 9, and the current source CS is connected to the current signal line 10. In this state, the switches Sw1, Sw5*a*, and Sw5*b* are closed.

In this case, however, in this state, the output current Iout from the current source CS is set to not the current Isig corresponding to the video signal but a predetermined reset current Irst of, e.g., 100 nA. Accordingly, the gate-to-source voltage of the drive transistor Tr is set to a value Vcrct when the current Irst flows between the source and drain. The first write period P3C is ended by opening the switches Sw5*a* and Sw5*b*.

During the second write period P3V, the gate-to-source voltage of the drive transistor Tr, which is set during the first write period P3C, is held, as described about the mth row selection period. More specifically, the switch Sw5*b* is kept open. During the second write period P3V, the switches SwV0, SwC1, and SwC2 are opened, and the switches SwV1 and SwV2 are closed.

In this case, however, in this state, the voltage signal Vout output from the voltage source VS is set to a voltage signal Vsig' of, e.g., 4V corresponding to the video signal. The voltage signal Vsig' falls within the range of, e.g., 0V to 6V. With this operation, a node E as a voltage signal input terminal is set to the potential Vsig'. The second write period P3V is ended by opening the switch Sw1.

As described above, at the time when the first write period P3C is ended, the potential of the node D is set to the value Vcrct when the current Irst flows between the source and drain of the drive transistor Tr. For this reason, when the potential of the node E is changed from, e.g., 0V to Vsig' during the second write period P3V, the potential of the node D changes from Vcrct to Vcrct+Vsig". Note that Vsig" is a value determined by the gate potential of the drive transistor Tr and the capacitance ratio of the capacitors C1 and C2. Hence, when design is done to display a certain gray level when the potential of the node D is Vsig, the voltage signal Vsig' to display the gray level may be defined to almost satisfy a relationship given by equation: Vsig=Vsig"+Vcrct (Av). Note that Vcrct (Av) is a value expected for the potential Vcrct and, for example, the average value of Vcrct for all pixels.

The potential Vcrct is affected not only by the threshold value of the drive transistor Tr but also by its mobility and dimensions. When the current Irst is sufficiently large, the potential Vcrct faithfully reflects the characteristic of the drive transistor Tr. Hence, at the time when the second write period P3V is ended, the characteristics of the drive transistor Tr are corrected.

During the holding period P4, the switch Sw2 is closed, as described about the mth row selection period. Accordingly, a current having a magnitude almost corresponding to the potential Vcrct+Vsig' flows to the display element 20. To execute the write for the next pixel row, the switches SwV0, SwC1, and SwC2 are closed, and the switches SwV1 and SwV2 are opened.

As described above, in the write operation for displaying a darker gray level, the sufficiently large reset current Irst is supplied between the source and drain of the drive transistor Tr first. With this operation, the correction signal Vcrct corresponding to the reset current Irst is supplied to the node D. Accordingly, the variations of the characteristics, i.e., the threshold value Vth, mobility, and dimensions of the drive transistor Tr are corrected. Next, the voltage signal Vsig' almost corresponding to the video signal is supplied to the node E, and the potential of the node D is set to Vcrct+Vsig'.

When the drive current equals the reset current Irst, the correction signal Vcrct completely eliminates the influence of the characteristics, i.e., the threshold value Vth, mobility, and dimensions of the drive transistor Tr on the drive current. On the other hand, when the drive current is different from the reset current Irst, the correction signal Vcrct does not completely eliminate the influence of the characteristics of the drive transistor Tr on the drive current. In the latter case, the correction signal Vcrct contains an error corresponding to the difference between the potential of the node E during the second write period P3V and the potential of the node E during the first write period P3C. If the potential difference is sufficiently small, the error of the correction signal Vcrct also becomes small. Hence, according to this embodiment, even when a darker gray level is displayed, the influences of the characteristics, i.e., the threshold value Vth, mobility, and dimensions of the drive transistor Tr on the drive current can almost completely be eliminated.

Only the outputs from the current source CS and voltage source VS change between the write operation for displaying a brighter gray level and that for displaying a darker gray level. That is, in the above method, the switching operation of each switch need not be changed in accordance with the gray level to be displayed. For this reason, no long time is required for the write operation on each pixel row.

In the circuit shown in FIG. 12, the output from the voltage source VS or the output from the current source CS is selected in the voltage/current source 25. For this reason, the number of output terminals of the voltage/current source 25 or the number of the input terminals of the video signal line driver can be one for each pixel row.

The fifth embodiment of the present invention will be described next.

Figure 14:
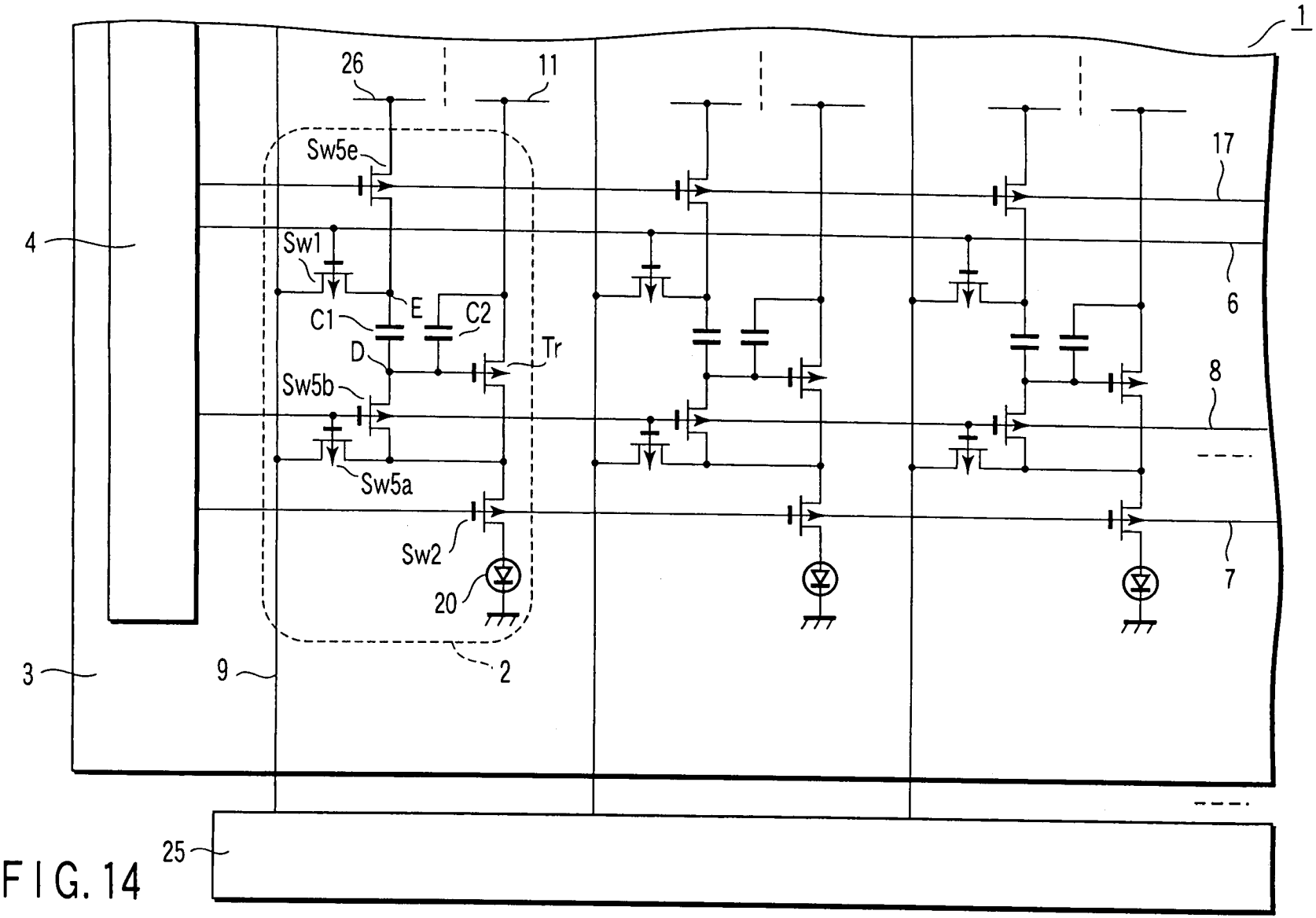
FIG. 14 is a plan view schematically showing a display according to the fifth embodiment of the present invention.

FIG. 14 is a plan view schematically showing a display according to the fifth embodiment of the present invention. A display 1 shown in FIG. 14 is, e.g., an organic EL display. The display 1 has the same structure as that of the display 1 shown in FIG. 11 except that the following arrangement is employed.

More specifically, in the display 1, current signal lines 10 are omitted. Instead, in the display 1, voltage signal lines 9 are used as voltage/current signal lines to which both a voltage signal and a current signal are supplied. In the display 1, a constant potential line 26 is arranged.

In each pixel 2, the drain of a switch Sw1 is connected to the voltage/current signal line 9. In addition, a correction signal supply control switch Sw5*e* connected between the source of the switch Sw1 and the constant potential line 26 is arranged. For example, a p-channel transistor is used as the switch Sw5*e*. For example, the source of the switch Sw5*e* is connected to the constant potential line 26. The source of the switch Sw5*e* may be connected to a power supply line 11. In this case, the constant potential line 26 can be omitted.

Scan signal lines 17 connected to a scan signal line driver 4 are arranged on a substrate 3. The gate of the switch Sw5*e* is connected to the scan signal line 17.

In the display 1, a video signal line driver 5 shown in FIG. 12 is omitted. Instead, the output terminals of a voltage/current source 25 are connected to the voltage/current signal lines 9 so that the voltage/current source 25 is used as the video signal line driver.

In the display 1, the substrate 3, scan signal lines 6 to 8 and 17, voltage/current signal lines 9, power supply line 11, constant potential line 26, switches Sw1, Sw2, Sw5*a*, Sw5*b*, and Sw5*e*, drive transistors Tr, and capacitors C1 and C2 form an active matrix substrate. This active matrix substrate can also include the scan signal line driver 4 and the like. This active matrix substrate can also include one electrode of each display element.

To display a brighter gray level corresponding to a drive current larger than, e.g., 100 nA, the display 1 is driven by, e.g., the following method.

For example, during the period when the pixels 2 which should display a brighter gray level are selected and, for example, the mth row selection period, the switch Sw2 is opened first, as described with reference to FIG. 13. Within the period when the switch Sw2 is open, the first write operation and second write operation are sequentially executed.

During a first write period P3C when the first write operation is executed, switches SwV0, SwC1, and SwC2 are closed, and switches SwV1 and SwV2 are opened, as described with reference to FIG. 13. More specifically, a voltage source VS is disconnected from the video signal line driver 5. In addition, a constant potential line 14 is connected to the voltage signal line 9, and a current source CS is connected to the current signal line 10. In this state, the switches Sw5*a*, Sw5*b*, and Sw5*e* are closed. The switch Sw1 is kept open.

In this state, an output current Iout from the current source CS is set to a current signal Isig corresponding to a video signal. Accordingly, the gate-to-source voltage of the drive transistor Tr is set to a value when the current Isig flows between the source and drain. The first write period P3C is ended by opening the switches Sw5*a* and Sw5*b*.

During a second write period P3V next to the first write period P3C, the switch Sw5*e* is opened. The switch Sw5*e* may be opened at this time or simultaneously as the switch Sw5*b* is opened.

During the second write period P3V, next, the switch SwC1 is opened, and the switches Sw1 and SwV1 are closed. In this case, the potential Vout at the output terminal of the voltage source VS almost equals a potential V0 of the constant potential line 26. After that, the switch Sw1 is opened. With this operation, the second write period P3V is ended.

During a holding period P4 next to the second write period P3V, the switch Sw2 is closed. Accordingly, a current having a magnitude almost equal to the current Isig flows to a display element 20. To execute the write for the next pixel row, the switch SwC1 is closed, and the switch SwV1 is opened.

In this embodiment, during the period when pixels which should display a darker gray level and, for example, the pixels 2 of the (m+1)th row are selected, the switch Sw2 is opened first, as described with reference to FIG. 13. Within the period when the switch Sw2 is open, the first write operation and second write operation are sequentially executed.

During the first write period P3C when the first write operation is executed, the switch SwC1 is closed, and the switch SwV1 is opened, as described about the mth row selection period. More specifically, the voltage source VS is disconnected from the voltage/current signal line 9. In addition, the current source CS is connected to the voltage/current signal line 9. In this state, the switches Sw5*a*, Sw5*b*, and Sw5*e* are closed. The switch Sw1 is kept open.

In this case, however, in this state, the output current Iout from the current source CS is set to not the current Isig corresponding to the video signal but a predetermined reset current Irst of, e.g., 100 nA. Accordingly, the gate-to-source voltage of the drive transistor Tr is set to a value Vcrct when the current Irst flows between the source and drain. The first write period P3C is ended by opening the switches Sw5*a* and Sw5*b*.

During the second write period P3V, the switch Sw5*e* is opened, as described about the mth row selection period. The switch Sw5*e* may be opened at this time or simultaneously as the switch Sw5*b* is opened.

During the second write period P3V, the switch SwC1 is opened, and the switches Sw1 and SwV1 are closed, as described about the mth row selection period.

In this case, however, in this state, the voltage signal Vout output from the voltage source VS is set to a voltage signal Vsig' almost corresponding to the video signal. With this operation, a node E is set to the potential Vsig'. The second write period P3V is ended by opening the switch Sw1.

As described in the fourth embodiment, at the time when the first write period P3C is ended, the potential of a node D is set to the value Vcrct when the current Irst flows between the source and drain of the drive transistor Tr. For this reason, when the potential of the node E is changed from V0 to Vsig' during the second write period P3V, the potential of the node D changes from Vcrct to Vcrct+Vsig"−V0. Hence, when design is done to display a certain gray level when the potential of the node D is Vsig, the voltage signal Vsig' to display the gray level may be defined to almost satisfy a relationship given by equation:

$$Vsig = Vsig'' + Vcrct(Av) - V0.$$

During the holding period P4, the switch Sw2 is closed, as described about the mth row selection period. A current having a magnitude almost corresponding to the potential Vcrct+Vsig"−V0 flows to the display element 20. To execute the write for the next pixel row, the switch SwC1 is closed, and the switch SwV1 is opened.

As described above, the driving method according to this embodiment is almost the same as in the fourth embodiment except that the power supply line 11 is used in place of the constant potential line 14. Hence, the same effect as described in the fourth embodiment can be obtained even in this embodiment.

As described above, in this embodiment, the constant potential line 26 is used in place of the constant potential line 14 used in the fourth embodiment. Accordingly, the switch Sw5*e* need be arranged in each pixel 2. Instead, the current signal line 10 and the video signal line driver 5 shown in FIG. 12 can be omitted.

The sixth embodiment of the present invention will be described next.

Figure 15:
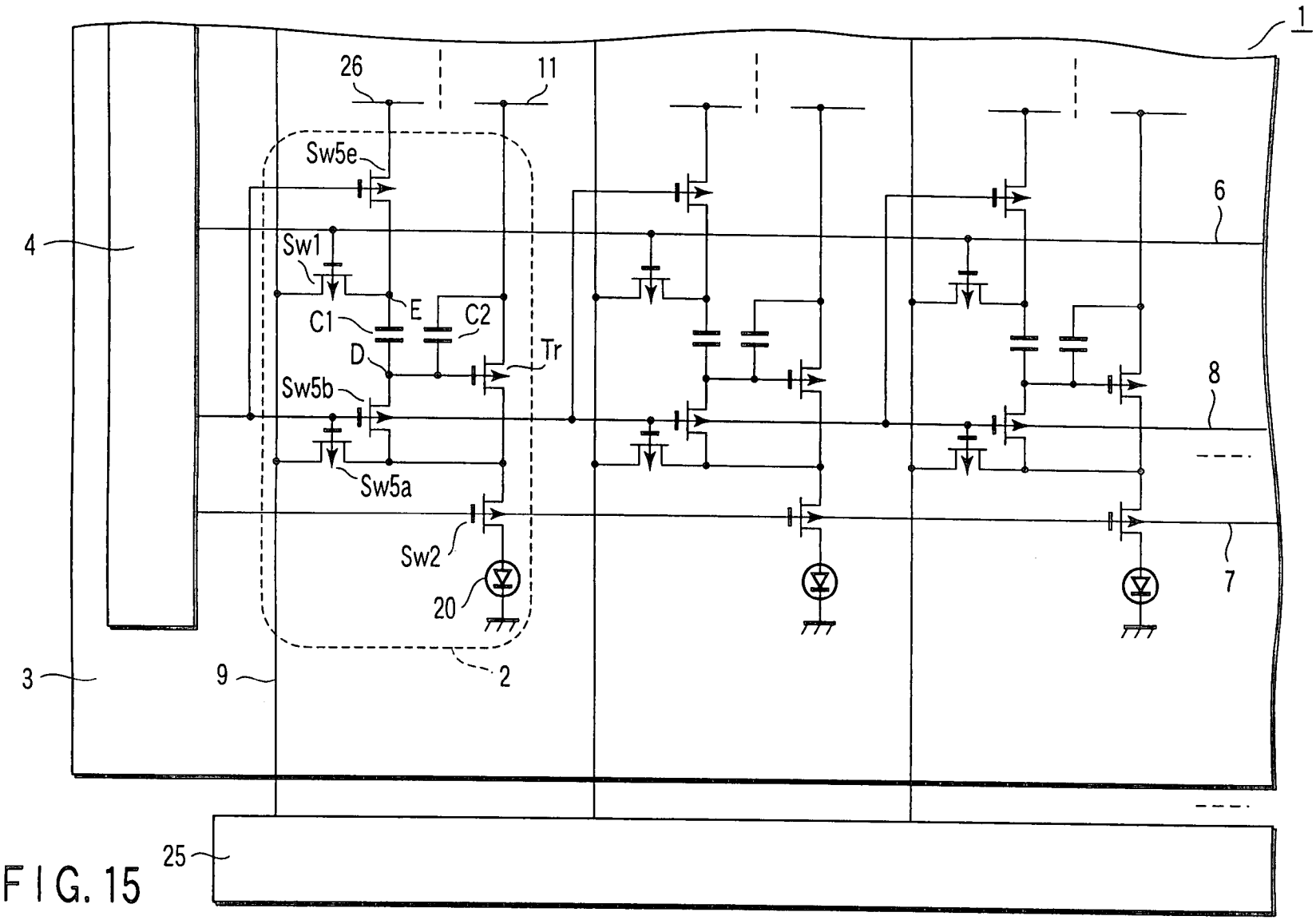
FIG. 15 is a plan view schematically showing a display according to the sixth embodiment of the present invention.

FIG. 15 is a plan view schematically showing a display according to the sixth embodiment of the present invention. A display 1 shown in FIG. 15 is, e.g., an organic EL display. The display 1 has the same structure as that of the display 1 shown in FIG. 14 except that scan signal lines 17 are omitted, and the gate of a switch Sw5*e* is connected to a scan signal line 8.

In the display 1 shown in FIG. 15, the switching operation of the switch Sw5*e* cannot be controlled independently of those of switches Sw5*a* and Sw5*b*. However, the display can be driven by the same method as described in the fifth embodiment. Hence, even in this embodiment, the same effect as described in the fifth embodiment can be obtained.

Additionally, in this embodiment, the scan signal lines 17 are omitted. That is, according to this embodiment, the number of wiring lines can be reduced as compared to the fifth embodiment.

The seventh embodiment of the present invention will be described next.

Figure 16:
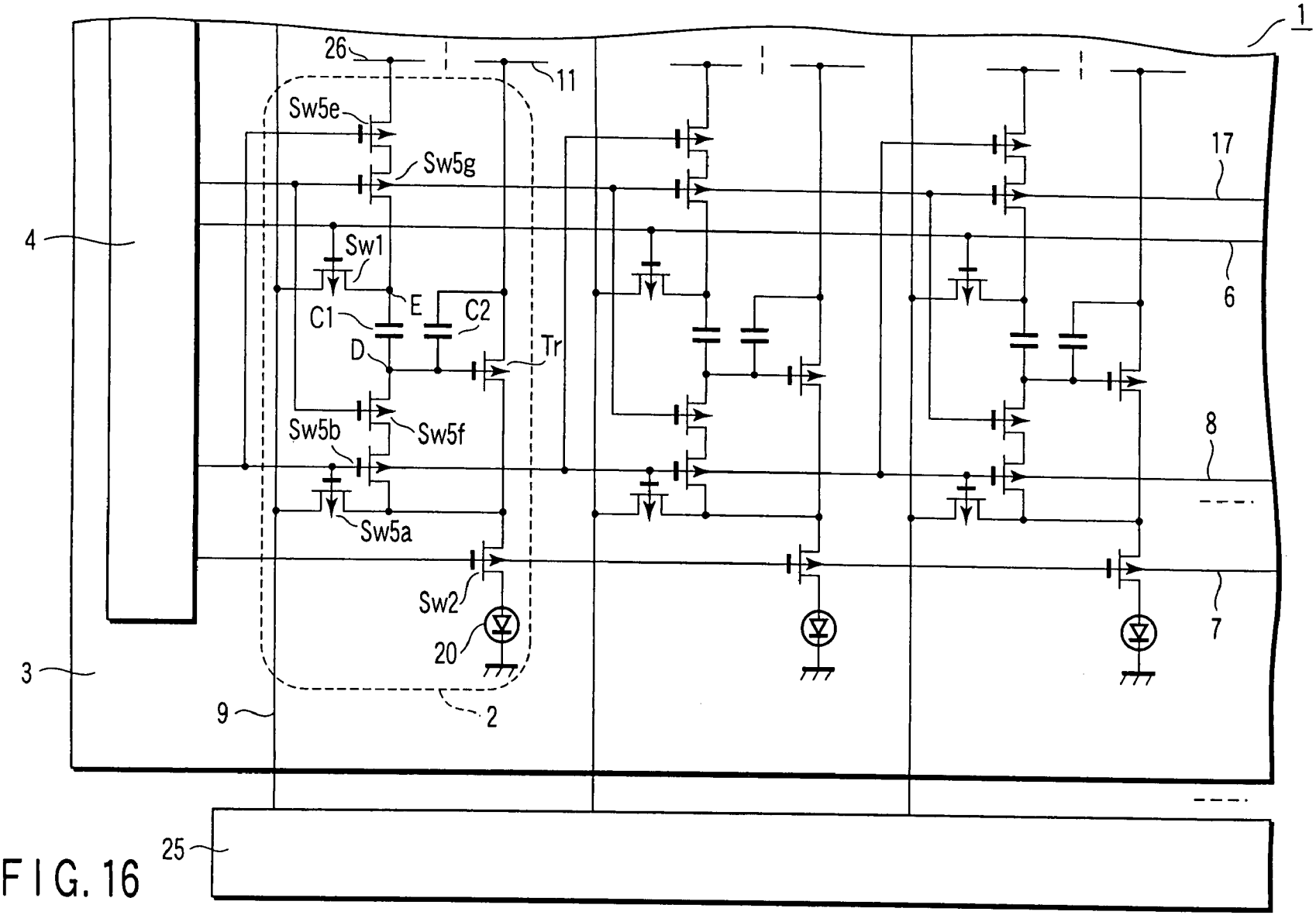
FIG. 16 is a plan view schematically showing a display according to the seventh embodiment of the present invention.

FIG. 16 is a plan view schematically showing a display according to the seventh embodiment of the present invention. A display 1 shown in FIG. 16 is, e.g., an organic EL display. The display 1 has the same structure as that of the display 1 shown in FIG. 15 except that the following arrangement is employed.

More specifically, in the display 1 shown in FIG. 16, correction signal supply control switches Sw5*f* and Sw5*g* and scan signal lines 17 are arranged. Each correction signal supply control switch Sw5*f* is connected between the output terminal of a correction signal supply control switch Sw5*b* and the gate of a drive transistor Tr. Switching of the correction signal supply control switch Sw5*f* is controlled by a scan signal supplied from a scan signal line 8. The correction signal supply control switch Sw5*g* is connected between the output terminal of a correction signal supply control switch Sw5*e* and the electrode of a capacitor C1 on the side of the switch Sw5*e*. Switching of the correction signal supply control switch Sw5*g* is controlled by a scan signal supplied from the scan signal line 17.

In the display 1, a substrate 3, scan signal lines 6 to 8 and 17, voltage/current signal lines 9, power supply line 11, constant potential line 26, switches Sw1, Sw2, Sw5*a*, Sw5*b*, Sw5*e*, Sw5*f*, and Sw5*g*, drive transistors Tr, and capacitors C1 and C2 form an active matrix substrate. This active matrix substrate can also include a scan signal line driver 4 and the like. This active matrix substrate can also include one electrode of each display element.

The display 1 shown in FIG. 16 can be driven by the same method as described in the sixth embodiment. Hence, even in this embodiment, the same effect as described in the sixth embodiment can be obtained.

In some cases, the switches Sw5*a* and Sw5*b* employ identical structures and are formed simultaneously. In this case, the switches Sw5*a* and Sw5*b* have the same threshold value in principle. In fact, the threshold value of the switches Sw5*a* and Sw5*b* may vary.

If the switches Sw5*a* and Sw5*b* have different threshold values, the switching operations are not simultaneously executed. For example, if the switch Sw5*a* is opened before the switch Sw5*b* is opened, the potential of a node D varies after the switch Sw5*b* is opened until the switch Sw5*a* is opened. That is, it may be difficult to sufficiently correct the characteristics of the drive transistor Tr.

In this embodiment, switching of the switch Sw5*f* can be controlled independently of switching of the switch Sw5*b*. Hence, during a first write period P3C, the switch Sw5*f* can be opened before the switch Sw5*b* is opened. For this reason, any undesirable variation of the potential of the node D can be prevented. Hence, the characteristic of the drive transistor Tr can reliably be corrected. This effect can also be obtained even when the switches Sw5*b* and Sw5*g* are not arranged.

In this embodiment, the switches Sw5*f* and Sw5*b* are connected in series between the gate and drain of the drive transistor Tr. The switches Sw5*g* and Sw5*e* are connected in series between the capacitor C1 and the constant potential line 26. With this structure, any leakage of charges accumulated in the capacitor C1 during the holding period P4 can be suppressed. More specifically, any variation of the gate potential of the drive transistor Tr during the holding period P4 can be suppressed.

The eighth embodiment of the present invention will be described next.

In the fourth to seventh embodiments, the write method is changed between display of a brighter gray level and display of a darker gray level. The eighth embodiment employs a method of displaying all gray levels by using the method of displaying a darker gray level, which has been described in the fourth to seventh embodiments.

Figure 17:
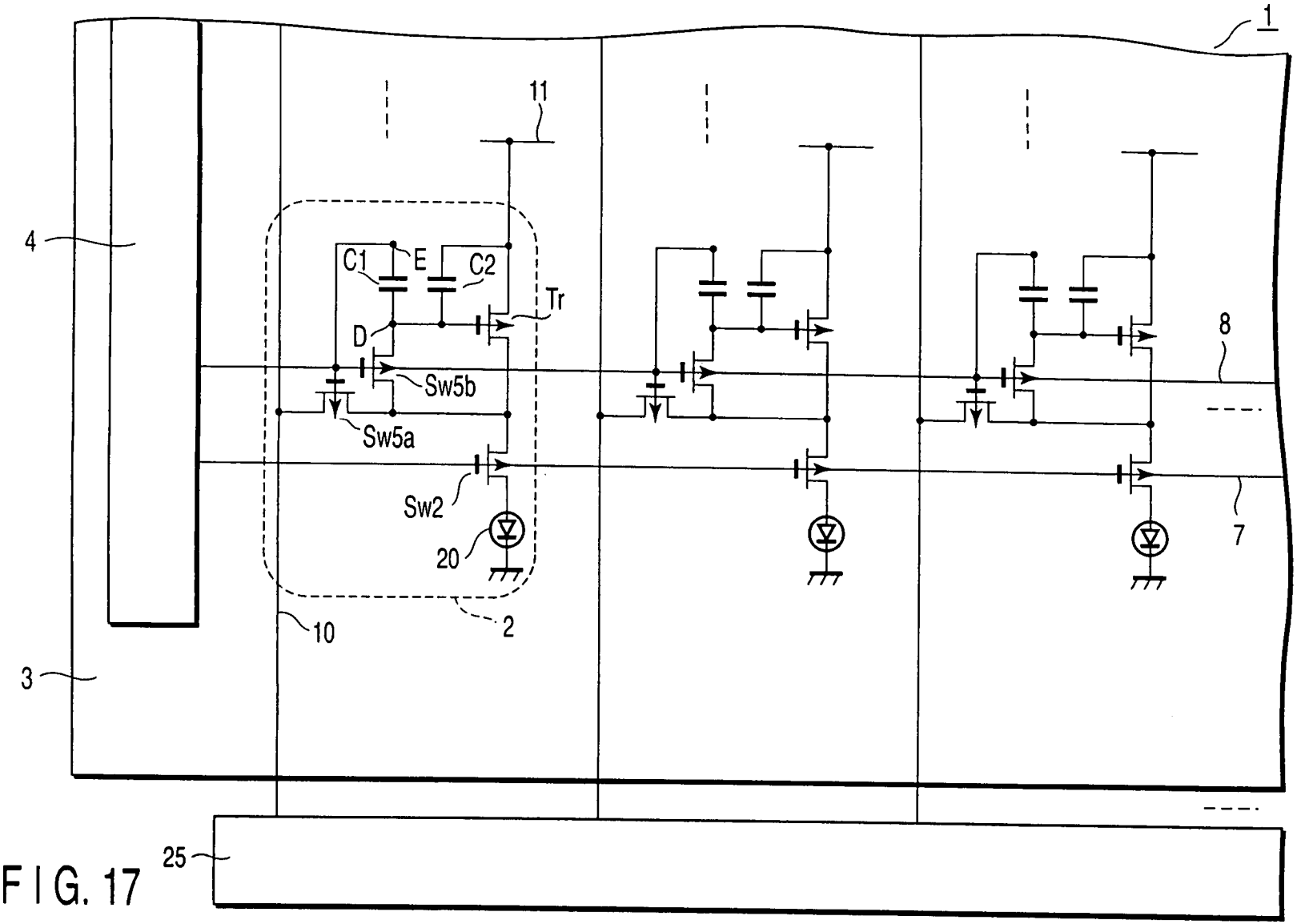
FIG. 17 is a plan view schematically showing a display according to the eighth embodiment of the present invention.

FIG. 17 is a plan view schematically showing a display according to the eighth embodiment of the present invention. A display 1 shown in FIG. 17 is, e.g., an organic EL display. The display 1 has the same structure as that of the display 1 shown in FIG. 11 except that the following arrangement is employed.

More specifically, in the display 1 shown in FIG. 17, a selection switch Sw1, scan signal lines 6, and voltage signal lines 9 are omitted, and nodes E are connected to scan signal lines 8.

In the display 1, a video signal line driver 5 is omitted. Additionally, in the display 1, a voltage source VS and switches SwC1 and SwV1 of a voltage/current source 25 are omitted. More specifically, the output terminals of the voltage/current source 25 are connected to the voltage/current signal lines 9 so that the voltage/current source 25 is used as the video signal line driver.

In the display 1, a substrate 3, scan signal lines 7 and 8, current signal lines 10, power supply line 11, switches Sw2, Sw5*a*, and Sw5*b*, drive transistors Tr, and capacitors C1 and C2 form an active matrix substrate. This active matrix substrate can also include a scan signal line driver 4 and the like. This active matrix substrate can also include one electrode of each display element.

In this embodiment, the display 1 is driven by, e.g., the following method independently of the gray level to be displayed.

During the period when pixels 2 which should display a certain gray level are selected, the switch Sw2 is opened first. Within the period when the switch Sw2 is open, the first write operation and second write operation are sequentially executed.

During a first write period P3C when the first write operation is executed, switches Sw5*a* and Sw5*b* are closed. In this state, an output current Iout from a current source CS is set to a current Isig' almost corresponding to a video signal. At this time, a potential V1 of the node E is constant independently of the gray level to be displayed. Accordingly, the gate-to-source voltage of the drive transistor Tr is set to a value Vsig' when the current Isig' flows between the source and drain. The first write period P3C is ended by opening the switches Sw5*a* and Sw5*b*.

During a second write period P3V when the second write operation is executed, the switches Sw5*a* and Sw5*b* are closed. At this time, a potential V2 of the node E is constant independently of the gray level to be displayed. The second write period P3V is ended when the node E stabilizes to the potential V2.

As described in the fourth embodiment, at the time when the first write period P3C is ended, the potential of a node D is set to the value Vsig' when the current Isig' flows between the source and drain of the drive transistor Tr. For this reason, when the potential of the node E is changed from V1 to V2 during the second write period P3V, the potential of the node D changes from Vsig' to Vsig'−(V1−V2).

During a holding period P4, the switch Sw2 is closed. A current Isig having a magnitude almost corresponding to the potential Vsig'−(V1−V2) flows to a display element 20.

In this example, since p-channel TFTs are used as the switches Sw5*a* and Sw5*b*, the potential V2 is higher than the potential V1. For this reason, the potential Vsig is higher than the potential Vsig'. In this example, a p-channel TFT is used as the drive transistor Tr. For this reason, the current Isig' is larger than the current Isig.

As described above, in this embodiment, in each write operation, the current signal Isig' is supplied between the source and drain of the drive transistor Tr as a video signal. With this operation, the potential of the node D is set to the value Vsig' corresponding to the video signal. As described above, the current Isig' is larger than the current Isig. Hence, the potential Vsig' faithfully reflects the characteristics of the drive transistor Tr. More specifically, according to this embodiment, not only the influence of a threshold value Vth of the drive transistor Tr but also the influence of its mobility and dimensions on the drive current can sufficiently be eliminated.

The ninth embodiment of the present invention will be described next.

Figure 18:
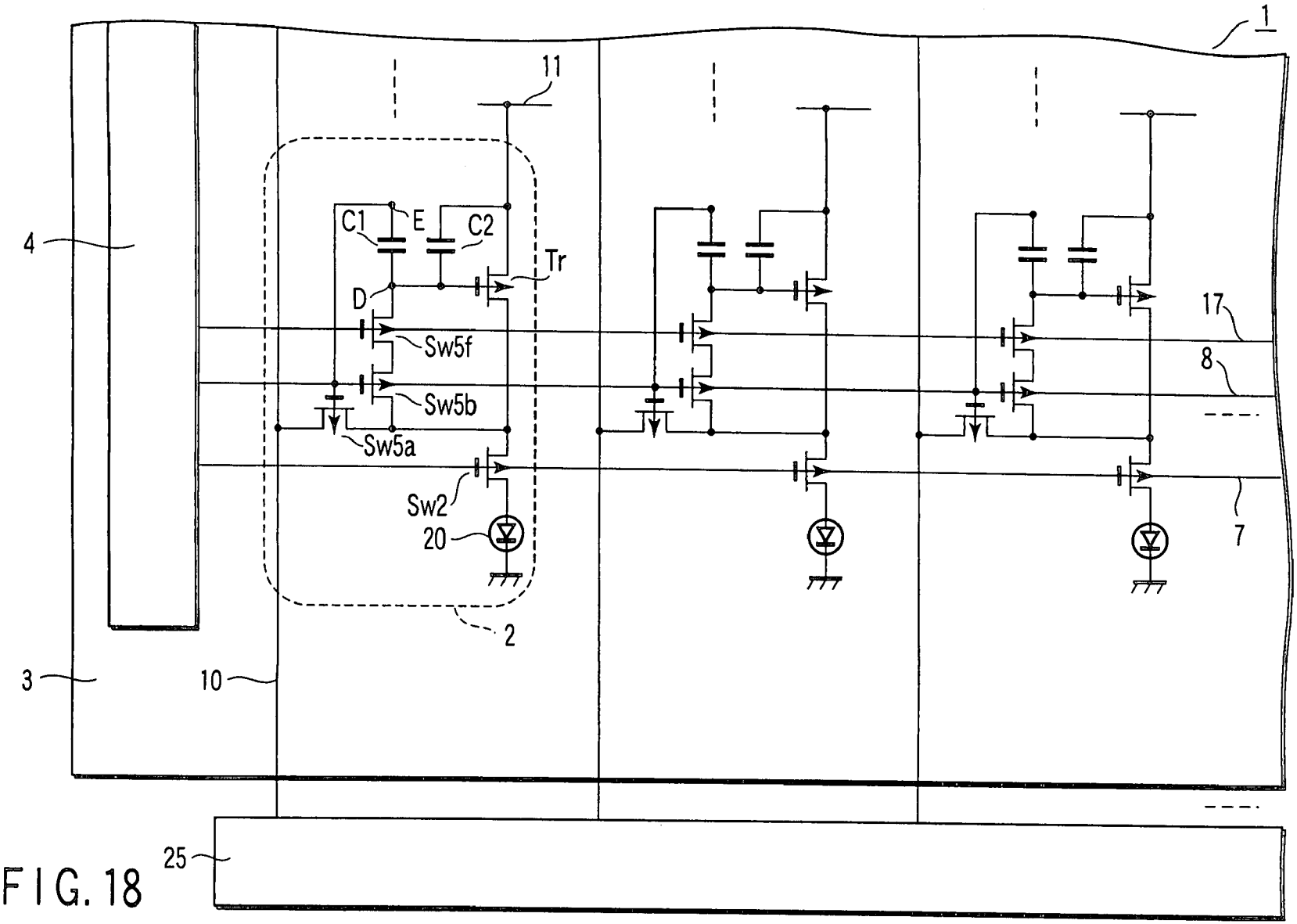
FIG. 18 is a plan view schematically showing a display according to the ninth embodiment of the present invention.

FIG. 18 is a plan view schematically showing a display according to the ninth embodiment of the present invention. A display 1 shown in FIG. 18 is, e.g., an organic EL display. The display 1 has the same structure as that of the display 1 shown in FIG. 17 except that the following arrangement is employed.

More specifically, in the display 1 shown in FIG. 18, a correction signal supply control switch Sw5*f* and scan signal lines 17 are arranged. The correction signal supply control switch Sw5*f* is connected between the output terminal of a correction signal supply control switch Sw5*b* and the gate of a drive transistor Tr. Switching of the correction signal supply control switch Sw5*f* is controlled by a scan signal supplied from the scan signal line 17.

In the display 1, a substrate 3, scan signal lines 7, 8, and 17, current signal lines 10, power supply line 11, switches Sw2, Sw5*a*, Sw5*b*, and Sw5*f*, drive transistors Tr, and capacitors C1 and C2 form an active matrix substrate. This active matrix substrate can also include a scan signal line driver 4 and the like. This active matrix substrate can also include one electrode of each display element.

The display 1 shown in FIG. 18 can be driven by the same method as described in the eighth embodiment. Hence, even in this embodiment, the same effect as described in the eighth embodiment can be obtained.

In this embodiment, switching of the switch Sw5*f* can be controlled independently of switching of the switch Sw5*b*. Hence, during a first write period P3C, the switch Sw5*f* can be opened before the potential of a node E is changed to open the switch Sw5*b*. For this reason, any undesirable variation of the potential of a node D can be prevented. Hence, the characteristics of the drive transistor Tr can reliably be corrected. This effect can also be obtained even when the switch Sw5*b* is not arranged.

In this embodiment, the switches Sw5*f* and Sw5*b* are connected in series between the gate and drain of the drive transistor Tr. With this structure, any leakage of charges accumulated in the capacitor C1 during a holding period P4 can be suppressed. More specifically, any variation of the gate potential of the drive transistor Tr during the holding period P4 can be suppressed.

The 10th embodiment of the present invention will be described next.

Figure 19:
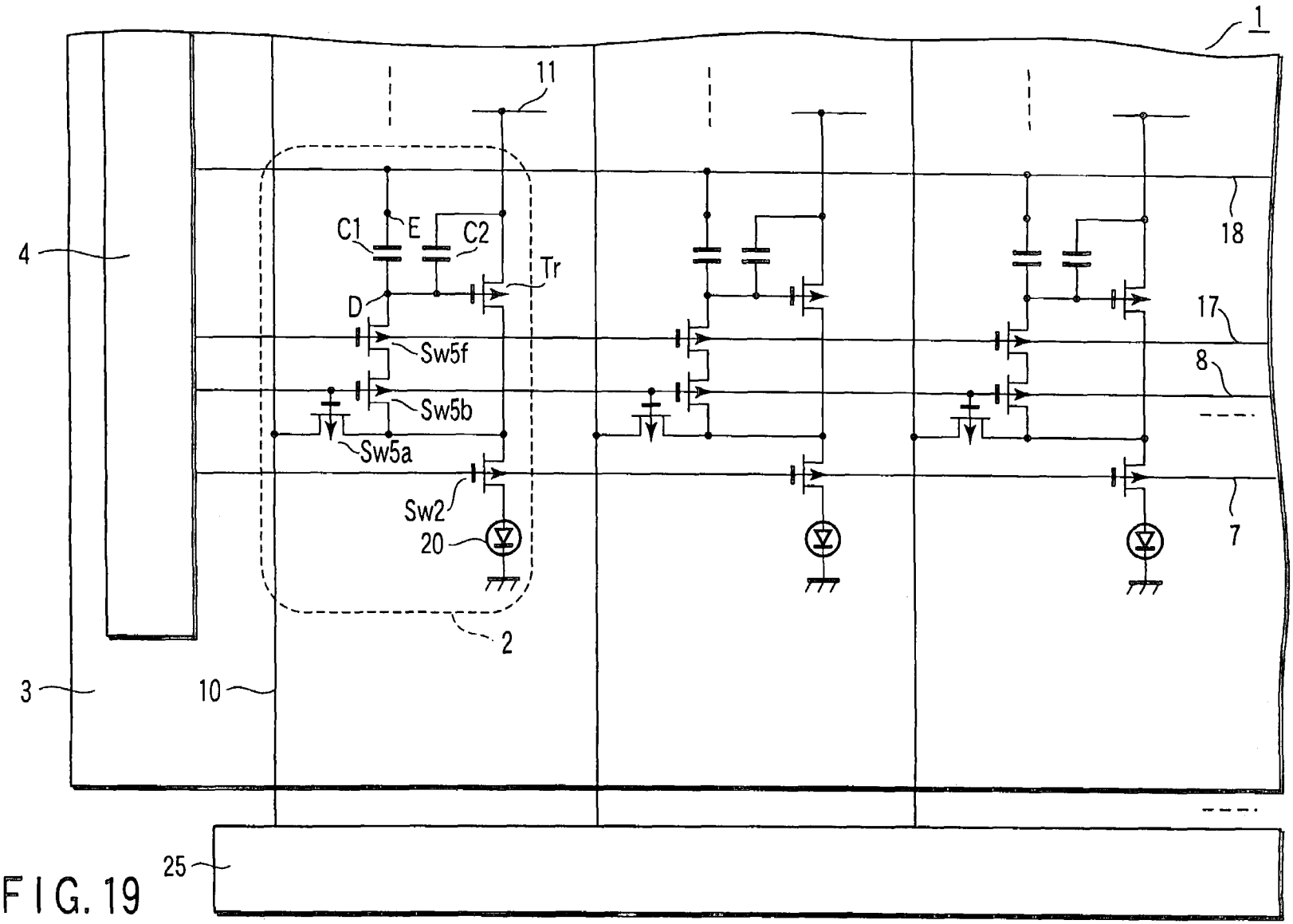
FIG. 19 is a plan view schematically showing a display according to the 10th embodiment of the present invention.

FIG. 19 is a plan view schematically showing a display according to the 10th embodiment of the present invention. A display 1 shown in FIG. 19 is, e.g., an organic EL display. The display 1 has the same structure as that of the display 1 shown in FIG. 18 except that the following arrangement is employed.

More specifically, in the display 1 shown in FIG. 19, scan signal lines 18 are arranged. Nodes E are connected not to scan signal lines 8 but to the scan signal lines 18.

In the display 1, a substrate 3, scan signal lines 7, 8, 17, and 18, current signal lines 10, power supply line 11, switches Sw2, Sw5*a*, Sw5*b*, and Sw5*f*, drive transistors Tr, and capacitors C1 and C2 form an active matrix substrate. This active matrix substrate can also include a scan signal line driver 4 and the like. This active matrix substrate can also include one electrode of each display element.

The display 1 shown in FIG. 19 can be driven by almost the same method as described in the ninth embodiment. Hence, even in this embodiment, the same effect as described in the ninth embodiment can be obtained. Even in this embodiment, the characteristic of the drive transistor Tr can reliably be corrected even when the switch Sw5*b* is not arranged.

In this embodiment, potentials V1 and V2 of the node E can arbitrarily be set. Additionally, in this embodiment, the potential of the node E can be changed independently of switching of the switches Sw5*a* and Sw5*b*.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A display comprising pixels arranged in a matrix, each of the pixels comprising:

a voltage signal input terminal to which a voltage signal is supplied;

a drive control element including a first terminal connected to a first power supply terminal, a control terminal, and a second terminal that outputs a current corresponding to a voltage between the first terminal and the control terminal;

a first capacitor connected between the voltage signal input terminal and the control terminal, wherein the voltage signal input terminal and the first power supply terminals are different terminals;

a second capacitor, one electrode of the second capacitor being connected to the control terminal and the other electrode of the capacitor being connected to a constant voltage source, wherein the constant voltage source is not the voltage signal input terminal;

a current signal input terminal to which a current signal is supplied; a first switch connected between the current signal input terminal and the control terminal;

a second switch connected between the current signal input terminal and the second terminal;

an output control switch whose input terminal is connected to the second terminal; and a display element connected between a second power supply terminal and an output terminal of the output control switch.

2. A display according to claim 1, further comprising:

scan signal lines arrayed in correspondence with rows of the pixels;

voltage signal lines arrayed in correspondence with columns of the pixels and each supplying the voltage signal to the voltage signal input terminal; and current signal lines arrayed in correspondence with the rows or columns of the pixels and each supplying the current signal to the current signal input terminal, wherein each of the pixels further comprises a selection switch connected between the voltage signal line and the voltage signal input terminal, a switching operation of the selection switch being controlled by a scan signal supplied from the scan signal line.

3. A display according to claim 1, further comprising:

scan signal lines arrayed in correspondence with rows of the pixels; and voltage/current signal lines arrayed in correspondence with columns of the pixels and each supplying the voltage signal and the current signal to the voltage signal input terminal and the current signal input terminal, respectively;

wherein each of the pixels further comprises a selection switch connected between the voltage/current signal line and the voltage signal input terminal, a switching operation of the selection switch being controlled by a scan signal supplied from the scan signal line.

4. A display according to claim 3, wherein each of the pixels further comprises a third switch connected between the voltage signal input terminal and a constant voltage source.

5. A display according to claim 1, wherein a control terminal of the first switch is connected to the voltage signal input terminal.

6. A display according to claim 1, wherein the first switch is connected to the current signal input terminal through the second switch.

7. A display according to claim 1, wherein each of the pixels further comprises a second capacitor, one electrode of the second capacitor being connected to the control terminal and the other electrode of the capacitor being connected to a constant voltage source.

8. A display according to claim 1, wherein the display element is an organic EL element.

9. A display comprising pixels arranged in a matrix, each of the pixels comprising:

a voltage signal input terminal to which a video signal and a reset signal are supplied as voltage signals;

a drive control element including a first terminal connected to a first power supply terminal, a control terminal, and a second terminal that outputs a current corresponding to a voltage between the first terminal and the control terminal;

a first capacitor connected between the voltage signal input terminal and the control terminal, wherein the voltage signal input terminal and the first power supply terminals are different terminals;

a second capacitor, one electrode of the second capacitor being connected to the control terminal and the other electrode of the capacitor being connected to a constant voltage source, wherein the constant voltage source is not the voltage signal input terminal;

a current signal input terminal to which a current signal is supplied; a first switch connected between the current signal input terminal and the control terminal;

a second switch connected between the current signal input terminal and the second terminal;

an output control switch whose input terminal is connected to the second terminal; and a display element connected between a second power supply terminal and an output terminal of the output control switch; and a correction signal supply control unit comprising the first switch and the second switch that forms first and second conductive paths during a period when the output control switch disconnects the display element from the second terminal, the first conductive path allowing a reset current to flow between the first and second terminals, and the second conductive path allowing charges to move between the control terminal and an outside of the pixel.

10. A display comprising pixels arranged in a matrix, each of the pixels comprising:

a voltage signal input terminal to which a reset signal is supplied as a voltage signal during a correction period and a video signal is supplied as a voltage signal during a write period next to the correction period;

a drive control element including a first terminal connected to a first power supply terminal, a control terminal, and a second terminal that outputs a current corresponding to the video signal;

a first capacitor connected between the voltage signal input terminal and the control terminal, wherein the voltage signal input terminal and the first power supply terminals are different terminals;

a second capacitor, one electrode of the second capacitor being connected to the control terminal and the other electrode of the capacitor being connected to a constant voltage source, wherein the constant voltage source is not the voltage signal input terminal;

a current signal input terminal to which a current signal is supplied; a first switch connected between the current signal input terminal and the control terminal;

a second switch connected between the current signal input terminal and the second terminal;

a display element to which the drive current is to be supplied, wherein the display element is connected to a second power supply terminal;

an output control switch whose input terminal is connected to the second terminal and whose output terminal is connected to the display element, wherein the output control switch disconnects the display element from the second terminal during the correction period and the write period and connects the display element to the second terminal after the write period; and a correction signal supply control unit comprising the first switch and the second switch that forms first and second conductive paths during the correction period and disconnects the second conductive path during the write period, the first conductive path allowing a reset current to flow between the first and second terminals, and the second conductive path allowing charges to move between the control terminal and an outside of the pixel, wherein during the correction period, a first electrode of the first capacitor that is connected to the voltage signal input terminal is set to a reset potential corresponding to the reset signal, and a second electrode of the first capacitor that is connected to the control terminal is set to a potential of the control terminal when the reset current flows between the first and second terminals, and during the write period, the first electrode is set to a potential corresponding to the video signal.

11. A display according to claim 9 or 10, wherein formation of the first and second conductive paths is done for each row of the pixels.

12. A display according to claim 9 or 10, wherein formation of the first and second conductive paths is done for each pixel.

13. A display comprising pixels arranged in a matrix, each of the pixels comprising:

a voltage signal input terminal to which a voltage signal is supplied;

a drive control element including a first terminal connected to a first power supply terminal, a control terminal, and a second terminal that outputs a current corresponding to a voltage between the first terminal and the control terminal;

a first capacitor connected between the voltage signal input terminal and the control terminal, wherein the voltage signal input terminal and the first power supply terminals are different terminals;

a second capacitor, one electrode of the second capacitor being connected to the control terminal and the other electrode of the capacitor being connected to a constant voltage source, wherein the constant voltage source is not the voltage signal input terminal;

a current signal input terminal to which a current signal is supplied; a first switch connected between the current signal input terminal and the control terminal;

a second switch connected between the current signal input terminal and the second terminal;

an output control switch whose input terminal is connected to the second terminal; and a display element connected between a second power supply terminal and an output terminal of the output control switch, wherein the display changes a write operation between first and second write operations on the basis of a gray level to be displayed, the first write operation includes setting the voltage signal input terminal to a first potential, and opening the output control switch and closing the first and second switches to supply a current as a video signal between the first and second terminals, and the second write operation includes setting the voltage signal input terminal to a second potential, and opening the output control switch and closing the first and second switches to supply a current as a reset signal between the first and second terminals, subsequently opening the first switch, and then setting the voltage signal input terminal to a potential corresponding to the video signal.

14. A display comprising pixels arranged in a matrix, each of the pixels comprising:

a voltage signal input terminal to which a voltage signal is supplied;

a drive control element including a first terminal connected to a first power supply terminal, a control terminal, and a second terminal that outputs a current corresponding to a voltage between the first terminal and the control terminal;

a first capacitor connected between the voltage signal input terminal and the control terminal, wherein the voltage signal input terminal and the first power supply terminals are different terminals;

a second capacitor, one electrode of the second capacitor being connected to the control terminal and the other electrode of the capacitor being connected to a constant voltage source, wherein the constant voltage source is not the voltage signal input terminal;

a current signal input terminal to which a current signal is supplied; a first switch connected between the current signal input terminal and the control terminal;

a second switch connected between the current signal input terminal and the second terminal;

an output control switch whose input terminal is connected to the second terminal; and a display element connected between a second power supply terminal and an output terminal of the output control switch, wherein a write operation of the display includes setting the voltage signal input terminal to a first potential, and opening the output control switch and closing the first and second switches to supply a current as a video signal between the first and second terminals, subsequently opening the first switch, and simultaneously or since then setting the voltage signal input terminal to a second potential different from the first potential.

15. An active matrix substrate on which a display element is to be formed, comprising:

a voltage signal input terminal to which a voltage signal is supplied;

a drive control element including a first terminal connected to a first power supply terminal, a control terminal, and a second terminal that outputs a current corresponding to a voltage between the first terminal and the control terminal;

a first capacitor connected between the voltage signal input terminal and the control terminal, wherein the voltage signal input terminal and the first power supply terminals are different terminals;

a second capacitor, one electrode of the second capacitor being connected to the control terminal and the other electrode of the capacitor being connected to a constant voltage source, wherein the constant voltage source is not the voltage signal input terminal;

a current signal input terminal to which a current signal is supplied; a first switch connected between the current signal input terminal and the control terminal;

a second switch connected between the current signal input terminal and the second terminal;

an output control switch whose input terminal is connected to the second terminal; and a display element connected between a second power supply terminal and an output terminal of the output control switch.

16. A method of driving a display comprising pixels arranged in a matrix, each of the pixels comprising a voltage signal input terminal to which a voltage signal is supplied, a drive control element including a first terminal connected to a first power supply terminal, a control terminal, and a second terminal that outputs a current corresponding to a voltage between the first terminal and the control terminal, a first capacitor connected between the voltage signal input terminal and the control terminal, wherein the voltage signal input terminal and the first power supply terminals are different terminals, a second capacitor, one electrode of the second capacitor being connected to the control terminal and the other electrode of the capacitor being connected to a constant voltage source, wherein the constant voltage source is not the voltage signal input terminal, a current signal input terminal to which a current signal is supplied; a first switch connected between the current signal input terminal and the control terminal, a second switch connected between the current signal input terminal and the second terminal, an output control switch whose input terminal is connected to the second terminal, and a display element connected between a second power supply terminal and an output terminal of the output control switch, comprising:

supplying through the second switch a current as a reset signal between the first terminal and the second terminal in a state that the voltage signal input terminal is set to a reset potential through the first capacitor, and the second capacitor is charged to a voltage corresponding to the current between the first and second terminals, the display element is disconnected from the second terminal by the output control switch, and the control terminal is connected externally from the pixel through the first switch, subsequently disconnecting the control terminal from the external connection by the first switch, and then setting the voltage signal input terminal to a potential corresponding to the video signal.

17. A method of driving a display comprising pixels arranged in a matrix, each of the pixels comprising a voltage signal input terminal to which a voltage signal is supplied, a drive control element including a first terminal connected to a first power supply terminal, a control terminal, and a second terminal that outputs a current corresponding to a voltage between the first terminal and the control terminal, a first capacitor connected between the voltage signal input terminal and the control terminal, wherein the voltage signal input terminal and the first power supply terminals are different terminals, a second capacitor, one electrode of the second capacitor being connected to the control terminal and the other electrode of the capacitor being connected to a constant voltage source, wherein the constant voltage source is not the voltage signal input terminal, a current signal input terminal to which a current signal is supplied; a first switch connected between the current signal input terminal and the control terminal, a second switch connected between the current signal input terminal and the second terminal, an output control switch whose input terminal is connected to the second terminal, and a display element connected between a second power supply terminal and an output terminal of the output control switch, comprising:

changing a write operation between first and second write operations on the basis of a gray level to be displayed, wherein the first write operation includes supplying through the second switch a current as a video signal between the first and second terminals in a state that the voltage signal input terminal is set to a first potential through the first capacitor, and the second capacitor is charged to a voltage corresponding to the current between the first and second terminals, the display element is disconnected from the second terminal by the output control switch, and the control terminal is connected to an outside of the pixel through the first switch, and the second write operation includes supplying through the second switch a current as a reset signal between the first and second terminals in a state that the voltage signal input terminal is set to a second potential through the first capacitor, the display element is disconnected from the second terminal by the output control switch, and the control terminal is connected to the outside of the pixel through the first switch, subsequently disconnecting the control terminal from the outside of the pixel, and then setting the voltage signal input terminal to a potential corresponding to the video signal.

18. A method of driving a display comprising pixels arranged in a matrix, each of the pixels comprising a voltage signal input terminal to which a voltage signal is supplied, a drive control element including a first terminal connected to a first power supply terminal, a control terminal, and a second terminal that outputs a current corresponding to a voltage between the first terminal and the control terminal, a first capacitor connected between the voltage signal input terminal and the control terminal, wherein the voltage signal input terminal and the first power supply terminals are different terminals, a second capacitor, one electrode of the second capacitor being connected to the control terminal and the other electrode of the capacitor being connected to a constant voltage source, wherein the constant voltage source is not the voltage signal input terminal, a current signal input terminal to which a current signal is supplied; a first switch connected between the current signal input terminal and the control terminal, a second switch connected between the current signal input terminal and the second terminal, an output control switch whose input terminal is connected to the second terminal, and a display element connected between a second power supply terminal and an output terminal of the output control switch, comprising:

setting the voltage signal input terminal to a first potential through the first capacitor, and opening the output control switch and closing the first and second switches to supply a current as a video signal between the first and second terminals, charging the second capacitor to a voltage corresponding to the current between the first and second terminals, subsequently opening the first switch, and simultaneously or since then setting the voltage signal input terminal to a second potential different from the first potential.

* * * * *